US007337514B2

(12) United States Patent
McKay

(10) Patent No.: US 7,337,514 B2
(45) Date of Patent: Mar. 4, 2008

(54) HYDRAULIC HAND TOOL

(75) Inventor: Albert A. McKay, Stoney Creek (CA)

(73) Assignee: Lokring Technology, LLC, Ontario (CA)

( * ) Notice: Subject to any disclaimer, the term of this patent is extended or adjusted under 35 U.S.C. 154(b) by 275 days.

(21) Appl. No.: 11/065,655

(22) Filed: Feb. 24, 2005

(65) Prior Publication Data

US 2005/0183258 A1 Aug. 25, 2005

Related U.S. Application Data

(60) Provisional application No. 60/547,319, filed on Feb. 24, 2004, provisional application No. 60/588,541, filed on Jul. 16, 2004.

(51) Int. Cl.
*B21J 9/12* (2006.01)
*B23P 11/00* (2006.01)

(52) U.S. Cl. ..... 29/237; 72/453.15; 72/453.16

(58) Field of Classification Search ..... 72/316, 72/318, 453.15, 453.16; 29/237
See application file for complete search history.

(56) References Cited

U.S. PATENT DOCUMENTS 3,299,496 A * 1/1967 Christensen ..... 29/237
4,189,817 A 2/1980 Moebius
4,257,135 A * 3/1981 Moebius ..... 29/237
4,942,757 A * 7/1990 Pecora ..... 72/453.16
5,297,325 A * 3/1994 Thelen ..... 29/237
5,305,510 A 4/1994 Croft et al.
5,483,731 A * 1/1996 Prendel et al. ..... 29/237
5,694,670 A 12/1997 Hosseinian et al.
5,782,128 A 7/1998 Barjesteh et al.
6,434,808 B1 8/2002 McKay
6,463,778 B1 * 10/2002 Johnston ..... 72/316
6,564,610 B2 * 5/2003 Lefavour et al. ..... 72/453.16
6,618,919 B1 9/2003 McKay
6,662,420 B1 12/2003 Rosier
6,823,573 B2 * 11/2004 Morrison et al. ..... 29/237

FOREIGN PATENT DOCUMENTS

EP 0 280 649 B1 10/1991

* cited by examiner

*Primary Examiner*—David B Jones
(74) *Attorney, Agent, or Firm*—Fay Sharpe LLP

(57) ABSTRACT

A handheld hydraulic assembly tool for advancing a fitting's swage ring onto a fitting's connecting body while a conduit is received in the connector body to mechanically and sealingly connect the fitting to the conduit includes a clamping assembly defining a piston chamber fluidly connected to a pump chamber. The clamping assembly has a fixed jaw adapted to engage one of the connector body and the swage ring and a moveable jaw adapted to engage the other of the connector body and the swage ring. A piston is disposed in the piston chamber. The piston and the moveable jaw are configured such that movement of the piston in a first direction moves the moveable jaw toward the fixed jaw thereby moving the swage ring axially onto the connector body to mechanically and sealingly connect the connector body to the conduit received therein when the jaws are engaged to the connector body and the swage ring. A pump body defines the pump chamber and is connected to the clamping assembly. A fluid reservoir is fluidly connected to the pump chamber. A manually-operated pump piston is disposed in the pump chamber for drawing hydraulic fluid from the fluid reservoir and forcing the drawn hydraulic fluid into the piston chamber to move the piston in the first direction.

25 Claims, 10 Drawing Sheets

HYDRAULIC HAND TOOL

This application claims priority of Provisional Patent Application Ser. No. 60/547,319, filed Feb. 24, 2004, entitled "Hydraulic Hand Tool" and Provisional Patent Application Ser. No. 60/588,541, filed Jul. 16, 2004, entitled "Hydraulic Hand Tool", both expressly incorporated herein by reference.

BACKGROUND

The present invention generally relates to installation tooling and, more specifically, to an entirely handheld tool for installing swage ring fittings. In one embodiment, the present invention finds particular application as a handheld installation tool for swage ring fittings that does not require a connection to a remote power source and will be described with particular reference thereto. It is to be appreciated, however, that the invention may relate to other similar environments and applications.

One type of fitting for fluid conduits, such as tubes or pipes, includes a connector body that fits loosely over the fluid conduit and a swage ring which compresses and/or physically deforms the connector body against the outside surface of the fluid conduit to provide one or more seals and to provide a strong mechanical connection.

Prior art tools for assembling such a fitting to a fluid conduit often include a fixed jaw, a moveable jaw and a hydraulic cylinder for moving the moveable jaw toward the fixed jaw. The jaws can be configured to grip the swage ring and the connector body such that, upon actuation, the jaws forcibly move the swage ring over the connector body thereby causing the connector body to compress or move into the fluid conduit to provide a seal and a mechanical connection. When the swaging is complete, hydraulic pressure in the hydraulic cylinder is reduced and a return spring returns the moveable jaw to its original position to allow the tool to be removed from the fitting.

Typically, these types of prior art tools receive hydraulic power via a hydraulic fluid pumped through a hydraulic hose assembly from a remotely positioned hydraulic pressure supply. The hydraulic pressure supply can include a pump and an electric motor for driving the pump. Due to the size and weight of these components, an operator typically only carries the tool portion and is limited in movement by the length of the hydraulic hose.

Examples of prior art installation tools are taught in U.S. Pat. No. 4,189,817 ("Hydraulic Assembly Tool for Tube Fittings"); U.S. Pat. No. 5,305,510 ("Hydraulic Assembly Tool with Improved Load Bearing Arrangement for Tube Fittings"); U.S. Pat. No. 5,694,670 ("Secure Swaging Tool"); U.S. Pat. No. 6,434,808 ("Compact Installation Tool"); and U.S. Pat. No. 6,618,919 ("Remote Actuation of Installation Tooling Pump"), all expressly incorporated herein by reference.

One drawback of these types of installation tools is their limited mobility due to the required hose connection to the hydraulic pressure supply and the relative non-mobility of the hydraulic pressure supply. Moreover, the prior art installation tools are often bulky and/or heavy which makes them difficult to use in remote or confined spaces. Accordingly, there is a need for an installation tool that is relatively mobile and able to reach and be used in remote and/or confined areas.(Any further improvements that allow an installation tool to be used, or at least more easily used, in a variety of work places and with a variety of fittings are also deemed desirable.

SUMMARY

In accordance with one aspect, a handheld hydraulic assembly tool is provided for advancing a fitting's swage ring onto a fitting's connector body while a conduit is received in the connector body to mechanically and sealingly connect the fitting to the conduit. More particularly, in accordance with this aspect, the hydraulic assembly tool includes a clamping assembly defining a piston chamber fluidly connected to a pump chamber. The clamping assembly has a fixed jaw adapted to engage one of the connector body and the swage ring and a moveable jaw adapted to engage the other of the connector body and the swage ring. A piston is disposed in the piston chamber. The piston and the moveable jaw are configured such that movement of the piston in a first direction moves the moveable jaw toward the fixed jaw thereby moving the swage ring axially onto the connector body to mechanically and sealingly connect the connector body to the conduit received therein when the jaws are engaged to the connector body and the swage ring. A pump body defines the pump chamber and is connected to the clamping assembly. A fluid reservoir is fluidly connected to the pump chamber. A manually-operated pump piston is disposed in the pump chamber for drawing hydraulic fluid from the fluid reservoir and forcing the drawn hydraulic fluid into the piston chamber to move the piston in the first direction.

In accordance with another aspect, a method of mechanically and sealingly connecting a fitting to a conduit using a handheld hydraulic assembly tool is provided. More particularly, in accordance with this aspect, fixed and moveable jaws of the hydraulic assembly tool are secured to a swage ring of the fitting and a connecting body of the fitting with a conduit received in the connector body. A pump piston disposed in a pump chamber of the hydraulic assembly tool is manually operated. Hydraulic fluid is drawn from a fluid reservoir of the hydraulic assembly tool into the pump chamber when the pump piston is moved in a first direction. The hydraulic fluid drawn into the pump chamber is forced into a piston chamber of the hydraulic assembly tool when the pump piston is moved in a second direction. The drawing of hydraulic fluid from the fluid reservoir into the pump chamber and the forcing of the drawn hydraulic fluid in the pump chamber into the piston chamber is repeated. A piston disposed in the piston chamber is moved with the hydraulic fluid forced in the piston chamber. The moveable jaw, with the piston, is moved toward the fixed jaw to axially move the swage ring onto the connector body to mechanically and sealingly connect the connector body to the conduit received therein.

In accordance with yet another aspect, a handheld hydraulic assembly tool is provided. More particularly, in accordance with this aspect, the tool includes a clamp body defining a piston chamber. A fixed jaw is one of formed integrally with the clamp body or secured to the clamp body. A moveable jaw is secured to and moveable relative to the clamp body. A piston is disposed in the piston chamber. Movement of the piston in a first direction moves the moveable jaw toward the fixed jaw. A tool body defines a pump chamber which is fluidly connected to the piston chamber. A fluid reservoir fluidly connects to the pump chamber. A pump piston is disposed in the pump chamber and is adapted to draw a hydraulic fluid from the fluid reservoir and force the hydraulic fluid into the piston chamber to move the piston in the first direction thereby moving the moveable jaw toward the fixed jaw.

DETAILED DESCRIPTION

Figure 1:
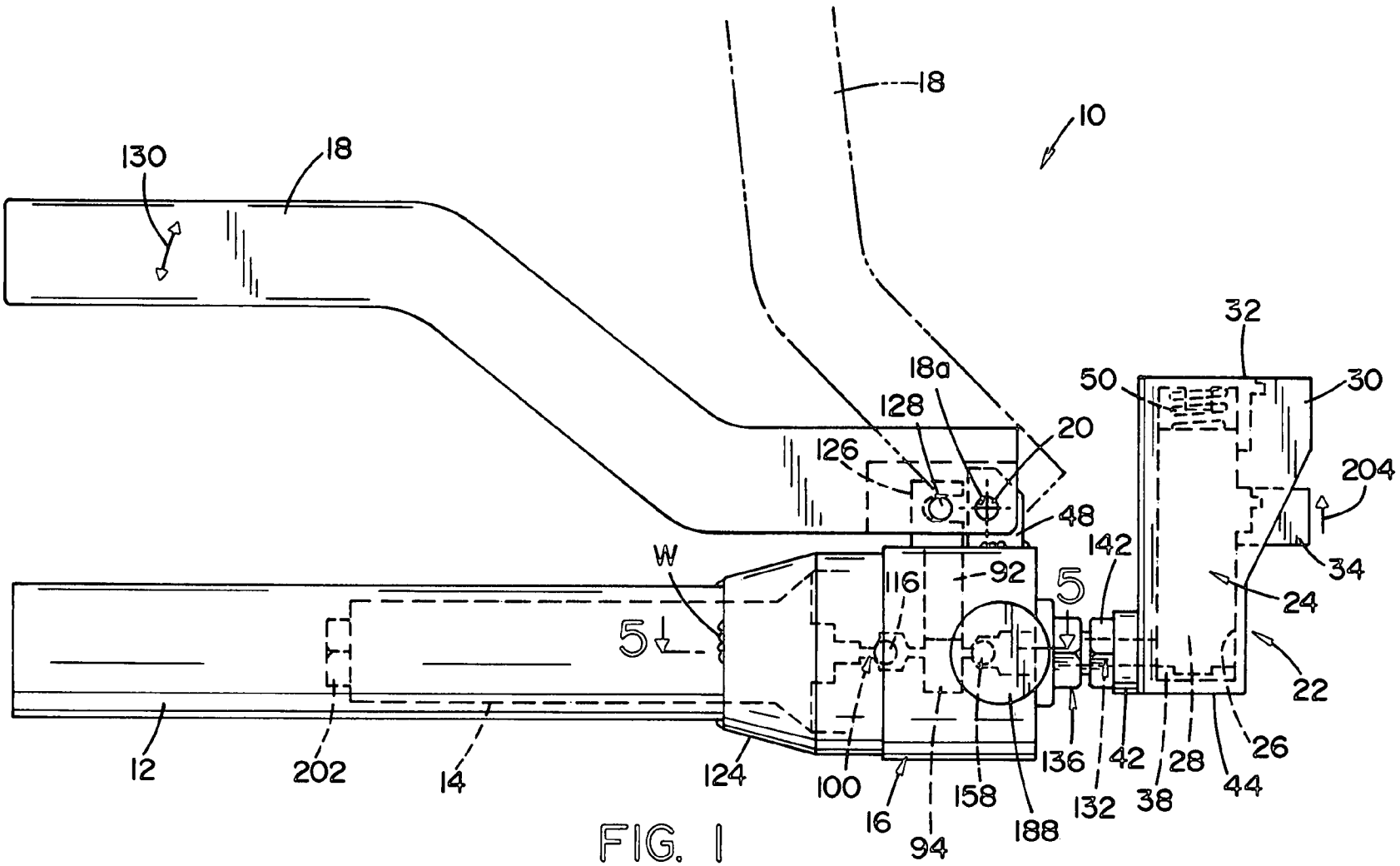
FIG. 1 is a side elevational view (with internal areas shown in hidden lines) of an installation tool in accordance with one embodiment.
Figure 2:
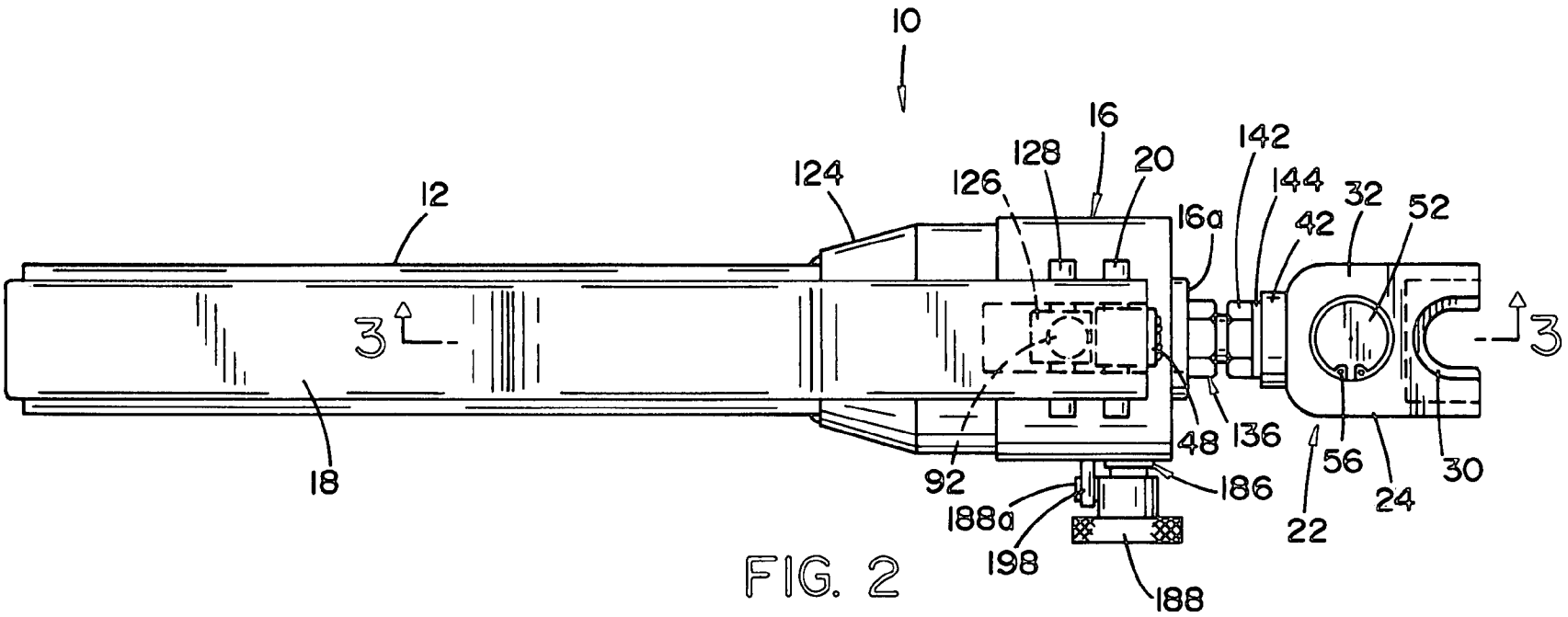
FIG. 2 is a top plan view of the installation tool of FIG. 1.
Figure 3:
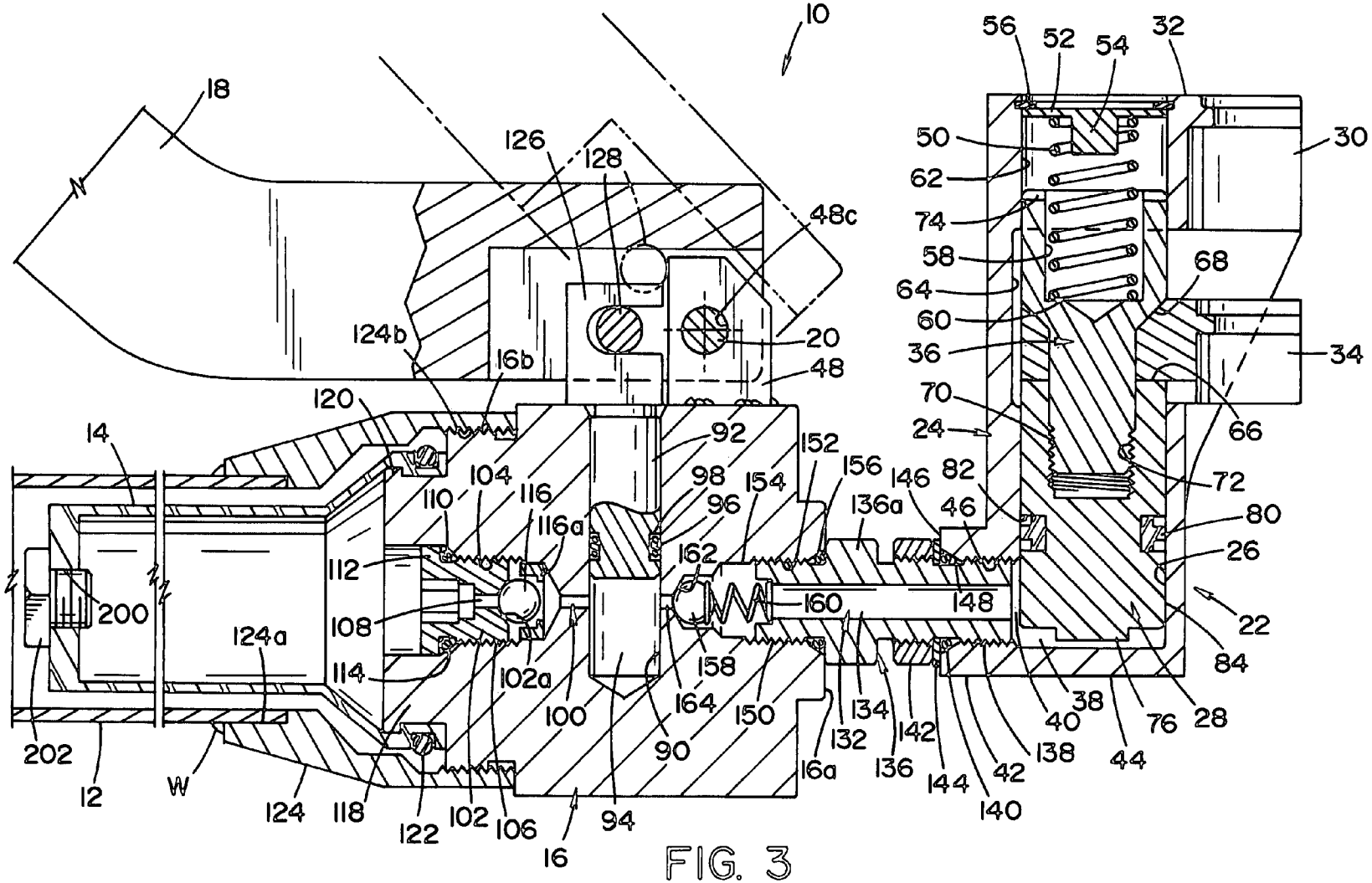
FIG. 3 is an enlarged cross-sectional view of the installation tool taken along the line 3-3 of FIG. 2.

Referring now to the drawings wherein the showings are for purposes of illustrating one or more embodiments only and not for purposes of limiting the same, FIG. 1 shows a handheld hydraulic installation tool assembly generally designated by reference numeral 10 in accordance with one embodiment. As will be described in more detail below, the installation tool 10 is a complete installation tool for installing swage ring fittings. The tool 10 can be entirely handheld and need not be connected to a remote power source, hydraulic or otherwise. The tool 10 can be used to connect a fitting and a fluid conduit together. More particularly, with brief reference to FIG. 4, the tool 10 can be used to axially move or advance a fitting's swage ring SR over a fitting's connector body CB of fitting F when or while a fluid conduit C is inserted or received in the connector body CB to compress or plastically deform the connector body CB into an outside surface 600 of the fluid conduit C which creates one or more seals and mechanically connects the connector body CB to the fluid conduit C.

With reference to FIGS. 1-5, the installation tool 10 includes a first handle 12 that houses a fluid reservoir or-bladder 14 containing a hydraulic fluid therein. In one embodiment, the bladder 14 disposed in the first handle 12 is formed of a flexible or rubber-like material that collapses as fluid is drawn therefrom. The first handle 12 forms a part of or is connected to a pump body 16 adjacent a forward end of the handle 12. A second handle 18 is pivotally connected to the body portion by a pivot pin 20 and is moveable relative to the first handle 12. In the illustrated embodiment, a raised boss or member 48 is welded to the body 16. The raised member 48 includes a throughhole 48*c* through which the pin 20 is received. The pin 20 is also received in throughholes 18*a* of the second handle 18 for pivotally connecting the handle 18 to the body 16.

The installation tool 10 additionally includes a clamping or engaging assembly 22 for engaging fittings F including connector bodies CB and swage rings SR. The clamping body 22 is connected to the pump body 16 as will be described in more detail below. The clamping assembly 22 includes a clamp body 24 that defines a proximal bore 26 having a piston 28 operatively received for movement therein. The clamping assembly 22 further includes a fixed jaw 30 fixedly secured to the clamping body 24 adjacent a distal end 32 thereof and a moveable jaw 34 connected to the piston 28 for movement therewith by a connecting member 36. In the illustrated embodiment, the fixed jaw 30 is, integrally formed with the clamp body 24. The fixed jaw 30 is adapted to engage either the connector body CB or the swage ring SR and the moveable jaw 34 is adapted to engage the other of the connector body and the swage ring.

The clamping body 24 and the fixed jaw 30 generally together form a tool fixed portion 24,30 of the clamping assembly 22. The moveable jaw member 34, the piston 28 and the connecting member 36 generally together form a tool moveable portion 28,34,36 of the clamping assembly 22. The clamping assembly 22 defines a piston chamber 38 in which the piston 28 is disposed. More particularly, a portion of the bore 26 forms the chamber 38 for receiving hydraulic fluid from the pump body 16. The chamber 38 is defined between a portion of the body 24 partially defining the bore 26 and the piston 28. In possible alternate embodiment, the piston 28 and the moveable jaw 34 can be integrally formed. As will be described in more detail below, the piston 28 and the moveable jaw 34 are configured such that movement of the piston in a first direction moves the moveable jaw 34 toward the fixed jaw 30. As will be understood and appreciated by those skilled in the art, when the jaws 30,34 are respectively engaged to the connector body CB and the swage ring SR, movement of the moveable jaw 34 toward the fixed jaw 30 moves the swage ring SR axially onto the connector body CB to mechanically and sealing connect the connector body to the fluid conduit C received therein.

The body 24 further includes a fluid port 40 defined by a fluid port portion 42 of the body 24 adjacent a proximal end 44 thereof and fluidly connected to the bore 26 and, more particularly, the chamber 38. The fluid port portion 42 has internal threads 46 for threadedly connecting to the pump body 16 to selectively receive pressurized hydraulic fluid from the pump body 16 as will be further described below. More particularly, the fluid port 40 delivers pressurized hydraulic fluid into the chamber 38 and to the piston 28 and, thereby, moves the moveable jaw 34 in the first direction, the direction of the hydraulic force, toward the distal end 32.

A compression spring 50 is disposed between the connecting member 36 and the body 24 adjacent the distal end 32 for urging the piston 28 in a second direction opposite the first direction. The spring 50 applies a compression force on the piston 28 and thereby urges the piston 28 and the connecting member 36 toward a first position (shown in FIG. 3) which is in a direction opposite the hydraulic force, i.e., toward the proximal end 44. When no hydraulic force is applied to the piston 28, the spring 50 urges or moves the moveable portion 28,34,36 toward the proximal end 44 and apart from the fixed jaw 30 and/or holds the tool moveable portion adjacent the proximal end. When a hydraulic force is applied to the piston 28 through the hydraulic fluid that is sufficient to overcome the urging of the spring 50, the tool moveable portion 28,34,36 is urged or moved toward the distal end 32 and toward the fixed jaw 30. More particularly, the compression spring 50 engages a fixed seat 52 provided at the distal end 32 of the body 24. The fixed seat 52 includes a central protuberance 54 for centering the spring 50 which is annularly disposed thereabout. The fixed seat 52 is fixedly attached to the distal end of the body 24 by a lock ring 56.

As already described, the connecting member 36 connects the piston 28 to the moveable jaw 34. The connecting member 36 includes a threadless internal bore 58 for receiving at least a portion of the compression spring 50. The internal bore 58 is partially defined by a moveable seat 60 against which the compression spring 50 rests. In the illustrated embodiment, the body 24 additionally includes a distal bore 62 adjacent the distal end 32. The connecting member 36 slidably engages the distal bore. 62 to guide the tool moveable portion 28,34,36 and to react to moment loads on the moveable jaw 34. Preferably, the distal bore 62 is concentric with the bore 26 and has a diameter substantially equal to a diameter of the bore 26. The body 24 additionally includes a cylindrical section 64 defining a clearance area disposed between the distal bore 62 and the bore 26. In the illustrated embodiment, the cylindrical section 64 has a diameter greater than that of the bore 62 and the bore 26. The clearance area serves to assist in preventing interference between the moveable jaw 34 and the body 24.

The moveable jaw 34 is captured between a first jaw engaging surface 66 of the piston 28 and a second jaw engaging surface 68 of the connecting member 36. This arrangement enables the piston 28, the moveable jaw 34 and the connecting member 36 (collectively, the tool moveable portion) to become and move as a solid unit or a unitary structure. Connecting member 36 includes male threads 70 that threadedly engage a threaded bore 72 defined in the piston 28. Preferably, the piston 28 is keyed to the moveable jaw 34 to prevent relative rotation of the piston 28 during attachment of the connecting member 36. Connecting member 36 also includes a tool engaging surface 74 for engagement with an assembly tool (not shown) used to rotate the connecting member 36 and threadedly attach the connecting member to the piston 28.

The piston includes a central protuberance 76 on one end thereof adjacent the proximal end 44. The central protuberance 76 and the body 24 together define the chamber 38. A hydraulic seal 80 is annularly disposed between the piston 28 and walls of the tool body 24 defining the bore 26 to prevent hydraulic fluid received in the bore 26 via the port 40 from passing thereby. In the illustrated embodiment, the seal 80 is a T-shaped seal disposed in a circumferential groove 82 defined in a diameter of the outer surface 84 that is substantially similar to (or slightly smaller than) the diameter of the bore 26, but allows the piston 26 to slidably move within the bore 26.

The pump body 16 includes a pump bore 90 having a manually-operated pump piston 92 received or disposed therein. The pump body 16 and, more specifically, the bore 90 together with the pump piston 92 define a pump chamber 94. The pump chamber 94 is fluidly connected to the piston chamber 38 and to the bladder 14 for receiving or drawing hydraulic fluid therefrom. The manually-operated pump piston 92 serves to move or draw hydraulic fluid from the bladder 14 into the pump chamber 94. The piston 92 also serves to force the drawn hydraulic fluid from the pump chamber 94 and into the piston chamber 38 to move the piston 28 in the first direction. A seal 96 is annularly disposed within a groove 98 on the piston 92 to prevent hydraulic fluid from passing by the piston and escaping from the pump body 16. As will be described in more detail below, the pump chamber 94 is fluidly connected to the piston chamber 38 and the bladder 14.

A first fluid passageway 100 is provided for fluidly connecting the bladder 14 to the pump chamber 94. Adjacent the bladder 14, a through plug. 102 is received in a threaded bore 104 of the pump body 16. More particularly, the through plug 102 includes threads 106 that threadedly connect the plug to the pump body 16. The through plug 102 includes a plug passageway 108 that forms a portion of the first passageway 100 that fluidly connects the bladder 14 to the pump chamber 94. A seal 110 is annularly disposed around the through plug 102 to prevent fluid from passing between an outer surface of the plug 102 and a surface defining the bore 104 of the pump body 16. More particularly, the seal 110 is interposed between a radial flange 112 of the through plug 102 and a tapered surface 114 of the pump body 16.

A first valve 116, such as a ball valve, is positioned between the reservoir 14 and the pump chamber 94. More specifically, the supply check valve 116 is disposed in the first passageway and, more particularly, at an inward end of the plug 102 for selectively controlling fluid communication between the bladder 14 and the pump chamber 94. In a closed position, the valve 116 seats against the plug 102 (and, more particularly, beveled surface 102*a* of the plug) and prevents the hydraulic fluid from entering the plug passageway 108 from the pump chamber 94, but allows fluid to pass from the bladder 14 into the pump chamber 94. Specifically, the valve 116 is moveable away from the plug 102 when hydraulic fluid passes from the bladder 14 to the chamber 94 and limited in movement by valve retainer 116*a*. When fluid attempts to leave the chamber 94 and pass back in to the bladder 14, the valve 116 returns to the plug 102 and prevents such passage of hydraulic fluid.

The pump body 16 also includes a bladder connecting portion 118 protruding cylindrically in the direction of the bladder 14. The connecting portion 118 includes a flange 120 to which the bladder 14 is attached. More specifically, the bladder 14 is pulled over the flange 120 and around the connecting portion 118. An 0-ring 122 is annularly disposed about the bladder 14 and the connecting portion 118 to further secure the bladder 14 to the body 16. The handle 12 is secured to the body 16 by a connector 124. In the illustrated embodiment, the connector 124 is welded to the handle 12 (illustrated schematically by weld W) and threadedly engaged to the body 16 thereby securing the handle 12 to the body 16. More specifically, the connector 124 includes a recess 124*a* for receiving the handle 12 to be welded and internal threads 124*b* that engage a threaded portion 16*b* of the body 16.

At an end of the pump piston 92 opposite an end received in the pump chamber 94, an external yoke 126 is formed and engaged to a force transfer pin 128. The force transfer pin 128 is mounted to the handle 18 so that upon movement of the handle 18 the force transfer pin 128 moves the pump piston 92 up and down in the pump chamber 94. More particularly, movement of the handle 18 relative to the handle 12 (as indicated by arrow 130 in FIG. 1) causes a reciprocating movement of the piston 92 in the chamber 94 for moving fluid through the tool 10. For causing the reciprocating movement, as shown in FIG. 1, the handle 18 can be moved between the illustrated first position and a second position shown in phantom lines about the pivot pin 20. In the illustrated embodiment, movement beyond the second position is limited by engagement between the force transfer pin 128 and the raised member 48. Movement of the handle 18 apart from the first handle 12 moves the pump piston 92 in a first direction drawings fluid from the fluid reservoir 14 into the pump chamber 94 and subsequently movement of the second handle toward the first handle forces the hydraulic fluid drawn into the pump chamber 94 into the piston chamber 38.

A second passageway 132 fluidly connects the pump chamber 94 to the chamber 38. The second passageway 132 is partially defined by the pump body 16 and partially formed by a throughhole 134 disposed in a connector 136. The connector 136 mechanically and fluidly connects the pump body 16 to the clamping assembly 22. In one embodiment, the connector 136 includes external threads 138 that threadedly engage threads 46 of the clamping body 24. A seal 140 is provided between the connector 136 and the clamping body 24 and a threaded member 142 locks against the tool body 24 and the seal 140 to secure the threaded connection between the connector 136 and the pump body 16. In the illustrated embodiment, a lock ring 144 is disposed between the threaded member 142 and an engaging surface 146 of the clamping body and the seal 140 is positioned between a lock ring 144 and a beveled edge 148 of the engaging surface 146.

Opposite the end threadedly engaged with the clamping assembly 22, the connector 136 includes additional external threads 150 that threadedly engage internal threads 152 partially defined along a bore 154 of the pump body 16. The connector 136 includes a radial flange 136*a* that seats against a raised portion 16*a* of the pump body. A seal 156 is disposed radially between the connector 136 (and, more specifically, the connector flange 136*a*) and the pump body 16 defining the bore 154. A second valve 158 is positioned between the pump chamber 94 and the piston chamber 38. More specifically, the valve 158 is disposed within the second passageway 132 for controlling fluid communication between the pump chamber 94 and the piston chamber 38. The valve 158 is urged to a closed position by a spring 160 wherein fluid communication from the chamber 38 to the chamber 94 is prevented; however, the valve 158 allows fluid flow from the chamber 94 toward and to the chamber 38. More particularly, the valve 158, which is a ball valve in the illustrated embodiment, seals and seals against a surface 162 disposed within the bore 154 when fluid flows from the chamber 38 toward the pump chamber 94 and prevents fluid communication through a passageway 164 defined by the pump body 16 that forms a portion of the second passageway 132.

Figure 5:
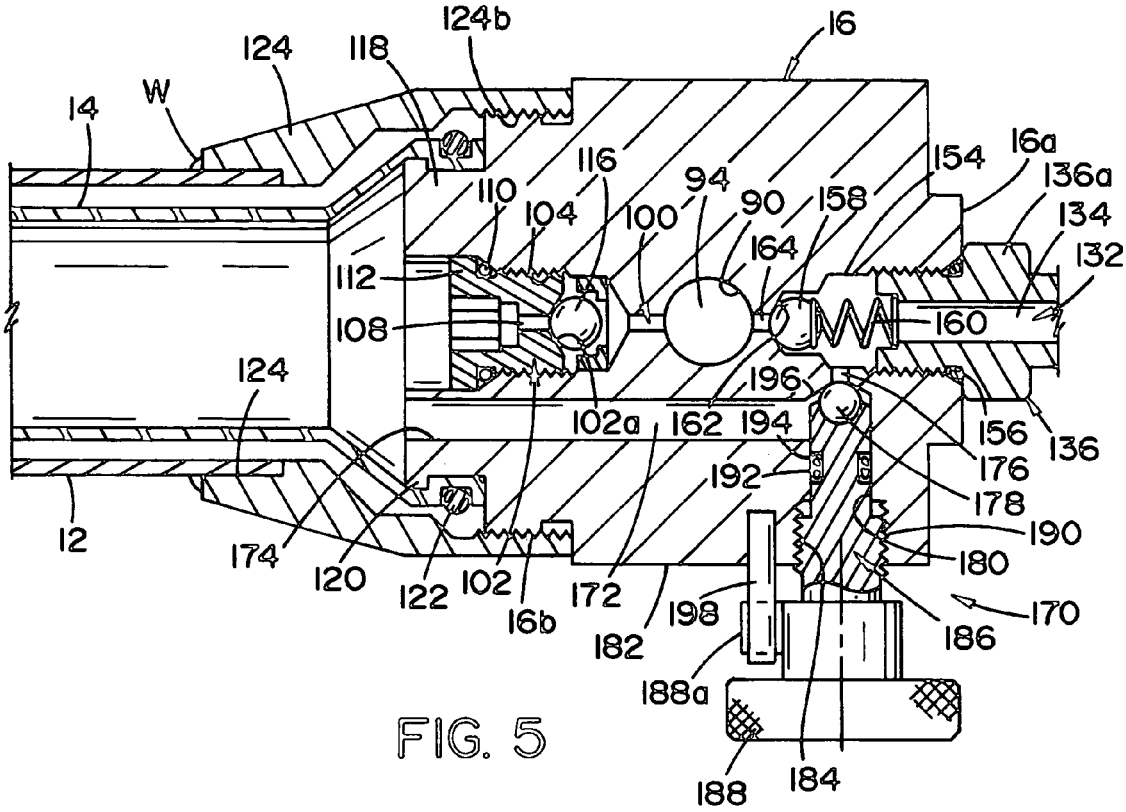
FIG. 5 is an enlarged cross-sectional view of the installation tool taken along the line 5-5 of FIG. 1.

With reference to FIG. 5, the pump body 16 includes a pressure release assembly 170 for selectively allowing hydraulic fluid to pass form the piston chamber 38 back to the reservoir 14 upon manual actuation thereof and bypass the first and second valves 116,158. The pressure release assembly 170 includes a bypass passageway 172 defined by a bore 174 in the body 16. The bypass passageway 172 fluidly connects the second passageway 132, which is connected to the chamber 38 (FIG. 3), and to the bladder 14. More particularly, the bypass passageway 172 is slightly offset relative to the second passageway 132, and a connecting passageway 176, oriented approximately normal relative to both the bypass passageway 172 and the second passageway 132, fluidly connects the second passageway 132 to the bypass passageway 172. A valve 178 is disposed in the bypass passageway for controlling fluid communication therethrough.

The bore 180 extends through the body from the bypass passageway 172 to an external side surface 182 of the body. In the illustrated embodiment, the relief bore 180 is concentric with the connecting passageway 176. A threaded counterbore 184 is provided along the relief bore 180 adjacent the exterior surface 182. A valve actuator 186 is received in the relief bore 180 and is operatively connected at one end to the valve 178. An opposite end of the actuator 186 protrudes from the body 16 and includes a knob 188 for manually operating the valve 178. Valve actuator 186 includes a diametrically expanded threaded portion 190 that threadedly engages the threaded counterbore 184 of the body 16. A seal 192 is disposed in an external groove 194 of the actuator 186 for preventing hydraulic fluid from escaping through the relief bore 180.

The valve 178 is forced closed, as illustrated in FIG. 5, by the threaded engagement between the threaded portion 190 and the threaded counterbore 184. To release or open the valve 178, the knob 188 is turned in a first direction (counterclockwise in the illustrated embodiment). To close the valve 178, the knob 188 is turned in a second direction (clockwise in the illustrated embodiment) and the threaded engagement between the actuator 186 and the body 16 forces the valve 178 closed against the beveled surface 196 positioned between the passageway 176 and the passageway 172. The knob 188 includes a flange portion 188*a* that engages a pin 198 extending from the surface 182 of the body 16. Engagement between the knob 188 and the pin limits relative rotation of the actuator 186. More specifically, this engagement limits rotation of the knob to approximately one full rotation (actually slightly less than one full rotation). In an alternate embodiment, a biasing means or mechanism, such as a spring, can be used to urge the actuator toward a closed position wherein the valve 178 prevents fluid communication between the passageway 176 and the passageway 172. In such an alternate embodiment, the actuator 186 would be required to be forcibly moved against the urging of the biasing mechanism.

In the illustrated embodiment, the bladder 14 is formed of a flexible material that allows the bladder to be filled with hydraulic fluid, but also allows the fluid to enter and exit the bladder without creating a vacuum effect. The bladder 14 can include an opening 200 which allows for filling of the bladder. A plug 202 can be provided for selectively closing the opening 200. In particular, the opening 200 can be provided for purposes of initially filling the bladder 14 and the plug 202 can then be attached to the bladder for closing of the opening 200. Preferably, when the bladder 14 is initially filled or otherwise filled with hydraulic fluid, all air is removed from the bladder, as well as the other chambers of the tool 10.

In operation, with the release valve 178 closed, the second handle 18 is moved apart from the first handle which creates a vacuum in the chamber 94. As a result, hydraulic fluid from the bladder 14 passes through the passageway 100 and enters the chamber 94. The vacuum force created is sufficient to allow the hydraulic fluid to pass the supply check valve 116, also referred to herein as the first valve. Once in the chamber 94, the valve 116 operates to prevent the hydraulic fluid from reentering the bladder 14. The second handle 18 is then moved toward the first handle which pressurizes the fluid in the chamber 94. The pressurized fluid is still prevented from entering the bladder 14 by the check valve 116 and instead forces open the valve 158, also referred to herein as the second valve, against the urging of the spring 160. Thus, the pressurized hydraulic fluid is forced through the second passageway 132 and into the chamber 38. The valve 158 operates to prevent hydraulic fluid in the piston chamber 38 from directly returning to the pump chamber 94.

This action, i.e., the movement of the pump piston 92, can then be repeated thereby forcing more pressurized fluid into the chamber 38. When the piston 92 is raised, the valve 158 functions to prevent fluid already in the chamber 38 from returning to the pump chamber 94, which results in fluid being drawn into the chamber 94 from the bladder 14. Thus, more and more fluid can be drawn from the bladder 14 with each stroke of the piston 92 and forced into the chamber 38 to move the piston 28 of the clamping assembly 22. As already described, movement of the piston 28 results in movement of the moveable jaw 34 toward the fixed jaw 30 in the first direction as indicated by arrow 204 (FIG. 1).

Figure 4:
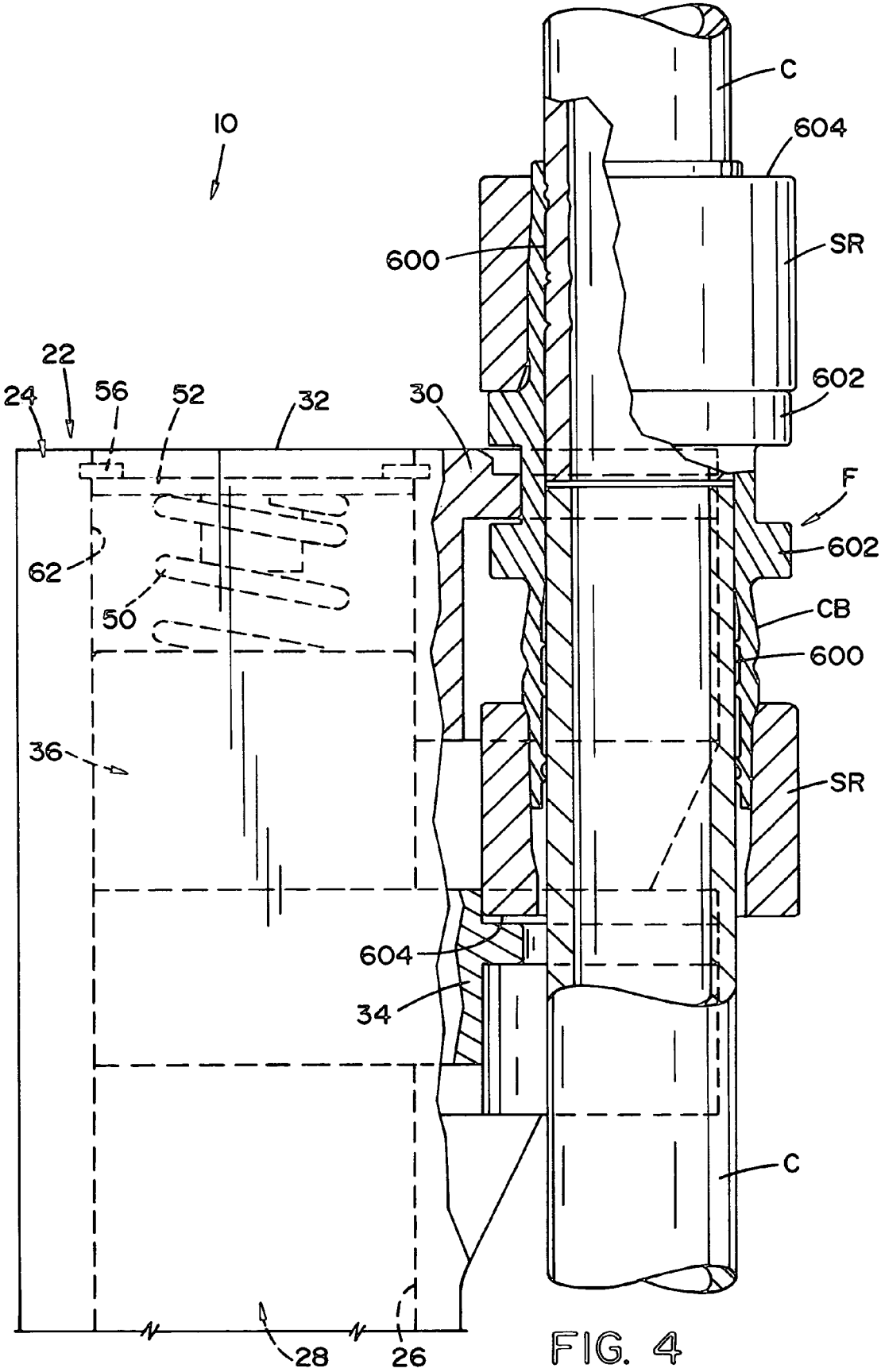
FIG. 4 is a side elevational view of the installation tool of FIG. 1 showing engagement with a fitting to be connected to a fluid conduit.

As will be known and appreciated by those skilled in the art, with specific reference to FIG. 4, the jaws 30,34 can be used for axially moving swage ring SR onto a fitting or connector body to sealingly and mechanically connect the body CB to a fluid conduit C. In the illustrated embodiment, the fixed jaw 30 engages radial flange 602 of the connector body CB and the moveable jaw 34 engages an end surface 604 of the swage ring SR. When used for axially moving swage ring SR onto connector body CB to secure fitting F to fluid conduit C, the fixed and moveable jaws 30,34 are first secured to the swage ring SR and the connector body CB with the fluid conduit C received in the connector body CB. Using the handles 12,18, the pump piston 92 is manually operated to draw hydraulic fluid from the fluid reservoir 14 into the pump chamber 94 when the piston 92 is moved in a first direction and to force the drawn hydraulic fluid into the piston chamber 38 when the piston 92 is moved in a second direction. These steps are repeated to draw more and more fluid from the bladder 14 and force more and more fluid into the piston chamber 38. This has the effect of moving the piston 28 with the hydraulic fluid forced in the piston chamber 38. Movement of the piston 28 moves the moveable jaw 34 toward the fixed jaw and axially moves the swage ring SR onto the connector body CB to mechanically and sealingly connect the connector body CB (and the fitting F) to the fluid conduit.

When desirable to release the jaws 30,34 from fitting F or to allow the moveable jaw 34 to move apart from the fixed jaw 30, the release knob 188 is turned in the first direction and moves the actuator 186, and ultimately the valve 178, outwardly from the relief bore 180 due to the helix of the threaded connection between the actuator 186 and the threaded counterbore 184. This provides a path, i.e., the bypass passageway 172, for the pressurized fluid in the chamber 38 to return to the bladder 14. Thus, when the knob 188 is turned in the first direction, the valve 178 is opened and the fluid in the chamber 38 returns to the bladder 14. As the fluid moves back toward the bladder 14, the spring 50 urges the piston 28 away from the fixed jaw 30 and allows movement of the moveable jaw 34 away from the fixed jaw 30. When desirable to again close the jaws, the release knob 188 is turned in the second direction to close the valve 178. Then, the handle 18 can again be pumped to reciprocally move the pump piston 92 and force hydraulic fluid from the bladder 14 to the piston chamber 38.

Figure 6:
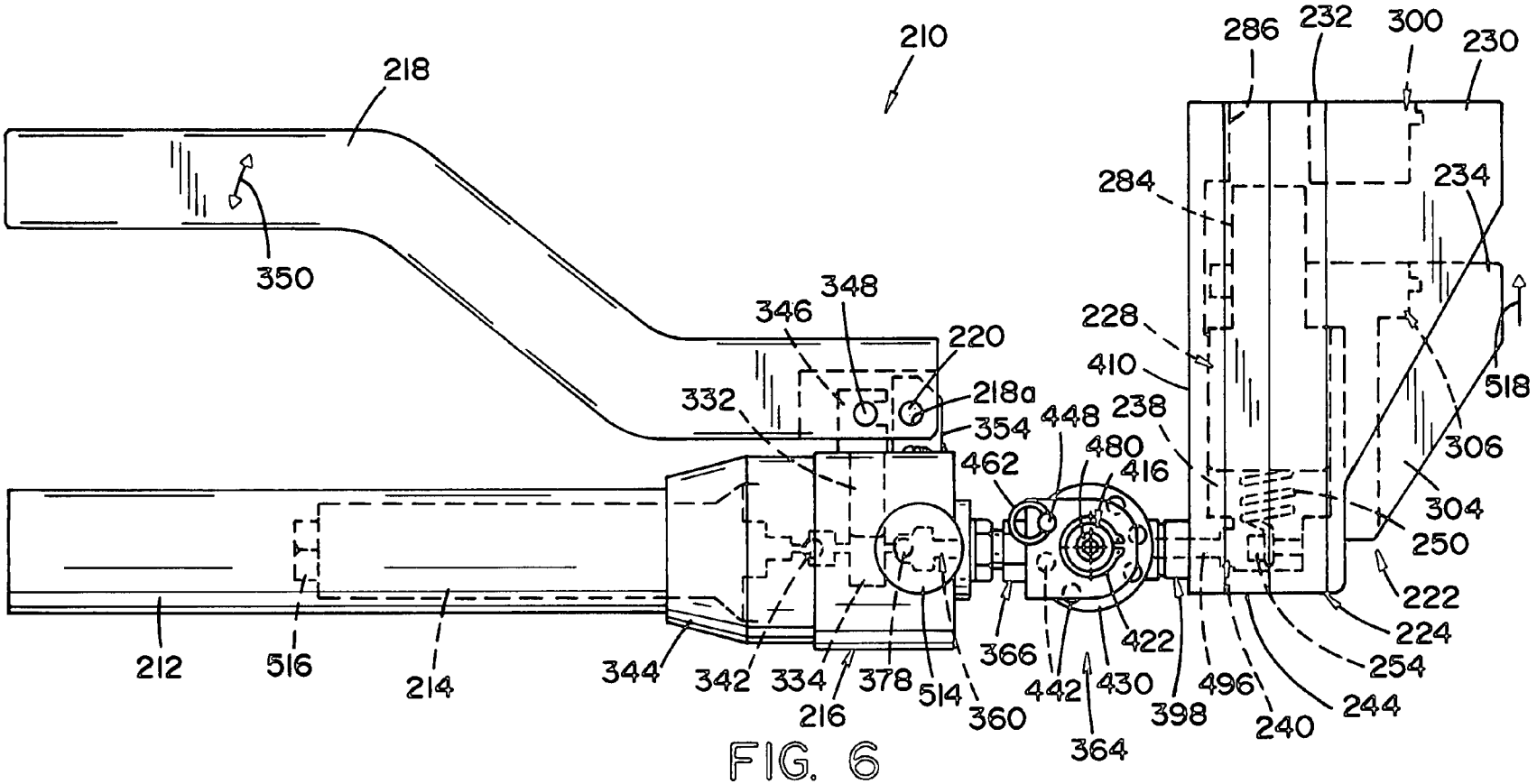
FIG. 6 is a side elevational view (with internal areas shown in hidden lines) of an installation tool in accordance with a second embodiment.

With reference to FIG. 6, an installation tool assembly is shown in accordance with a second embodiment and generally designated by reference numeral 210. Like the installation tool 10 of the first embodiment, the installation tool 210 is a complete installation tool for installing swage ring fittings. The tool 210 can be entirely handheld and need not be connected to a remote power source, hydraulic or otherwise. In one application, like the tool 10 of the first embodiment and shown in FIG. 4, the tool 210 is adapted to connect fitting F and fluid conduit C together. Specifically, the tool 210 is used to axially move swage ring SR over connector body CB of the fitting F when fluid conduit C is inserted therein to compress or plastically deform the connector body CB into an outside surface of the fluid conduit C which creates one or more seals and mechanically connects the connector body CB to the fluid conduit C.

Except as indicated below, the installation tool 210 is like or identical to the installation tool 10. More particularly, the installation tool 210 includes a first handle 212 that houses a fluid reservoir or bladder 214, like the bladder 14 of the first embodiment, containing a hydraulic fluid. The first handle 212 forms a part of or is connected to a pump body 216 adjacent a forward end of the handle 212. In the illustrated embodiment, the first handle 212 connects to the body 16 in the same manner as in the first embodiment installation tool 10. A second handle 218 is pivotally connected to the pump body 216 by a pivot pin 220. The installation tool 210 additionally includes a clamping or engaging assembly 222 for engaging fittings F including connector bodies CB and swage rings SR. The clamping assembly 222 is connected to the pump body 216 as will be described in more detail below.

Figure 7:
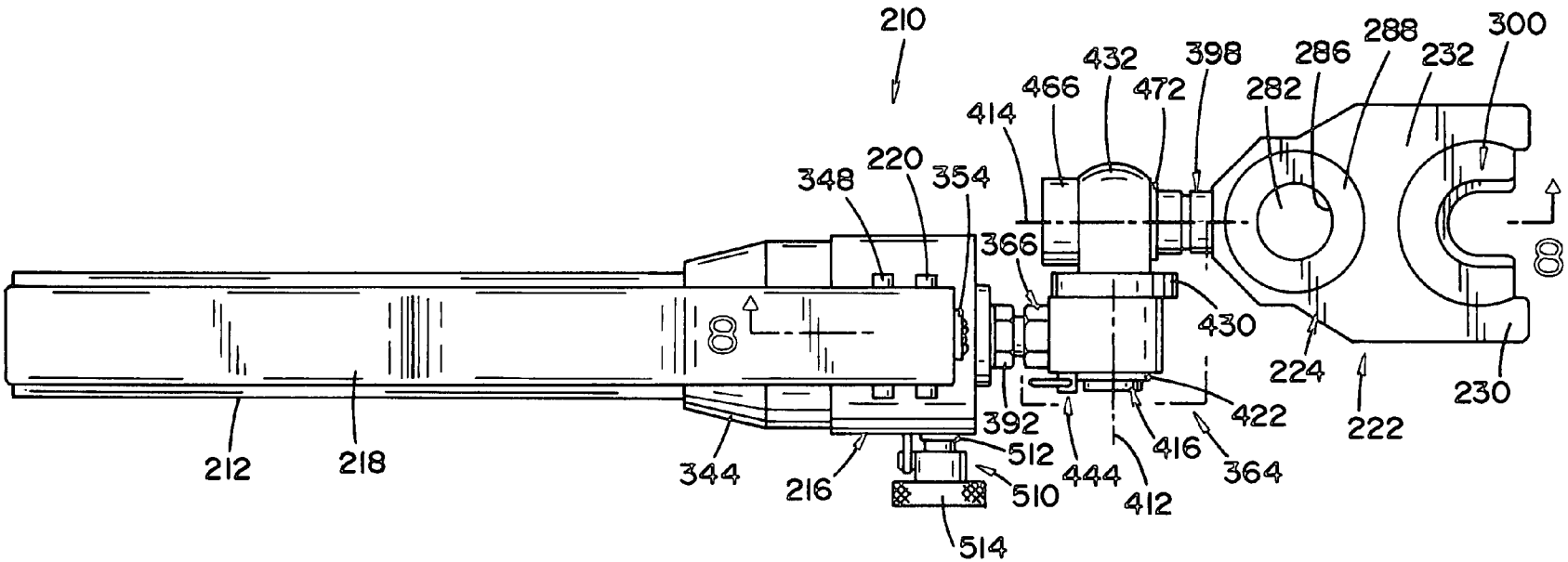
FIG. 7 is a top plan view of the installation tool of FIG. 6.
Figure 8:
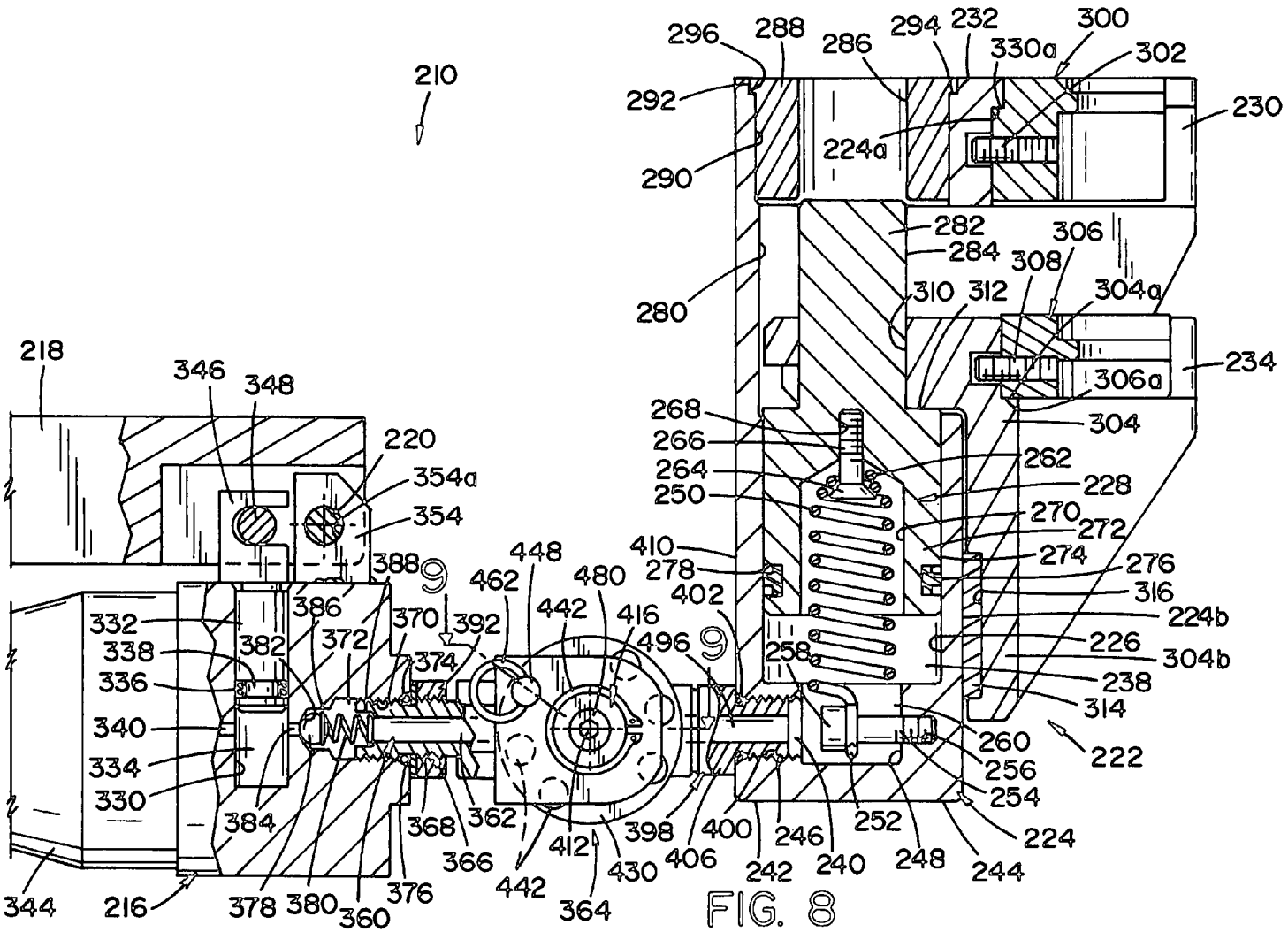
FIG. 8 is an enlarged cross-sectional view of the installation tool of FIG. 6 taken along the line 8-8 of FIG. 7.

With additional reference to FIGS. 7 and 8, the clamping assembly 222 includes a clamp body 224 that defines a proximal bore 226 having a piston 228 operatively received for movement therein. The clamping assembly 222 further includes a fixed jaw 230 fixedly secured to the body 224, or formed integrally therewith, adjacent a distal end 232 of the body 224 and a moveable jaw 234 connected to the piston 228 for movement therewith. Specifically, in the illustrated embodiment, the moveable jaw 234 is press fit onto the piston 228 (i.e., an interference fit connection) to fixedly secure the jaw member 234 to the piston for movement therewith. The body 224 and the fixed jaw 230 generally together form a fixed portion 224,230 of the clamping assembly 222. The moveable jaw 234 and the piston 228 generally together form a moveable portion 228,234 of the clamping assembly 222. A portion of the bore 226 forms a chamber 238 for receiving hydraulic fluid from the pump body 216. More specifically, the chamber 238 is defined between a portion of the body 224 defining the bore 226 and the piston 228.

The body 224 further includes a fluid port 240 defined by a fluid port portion 242 of the body 224 adjacent a proximal end 244 and fluidly connected to the bore 226 and, more particularly, the chamber 238. The fluid port portion 242 has internal threads 246 for threadedly connecting to the pump body, as will be further described below, to selectively receive pressurized hydraulic fluid from the pump body 216. More particularly, the fluid port 240 delivers pressurized hydraulic fluid to the chamber 238 and to the piston 228 to move the piston and, thereby, the moveable jaw 234 in a first direction, the direction of the hydraulic force and toward the distal end 232. In the illustrated embodiment, a further proximal bore 248 fluidly connects the fluid port 240 to the piston chamber 238.

A tension spring 250 is disposed in the bore 226 between the piston 228 and the clamping body 224 adjacent the proximal end 244 for urging the piston 228 in a second direction. The tension spring 250 applies a tension force on the piston 228 and urges the piston 228 toward a first position (shown in FIG. 8) which is in the second direction opposite the first direction and opposite the hydraulic force, i.e., toward the proximal end 244. When no hydraulic force is applied to the piston 228, the spring 250 urges or moves the tool moveable portion 228,234 toward the proximal end and apart from the fixed jaw 230 and/or holds the tool moveable portion adjacent the proximal end. When a hydraulic force is applied to the piston 228 through the hydraulic fluid that is sufficient to overcome the urging of the spring 250, the tool moveable portion 228,234 is urged or moved toward the distal end 232 and toward the fixed jaw 230.

More particularly, a first end 252 of the spring is secured to the body 224 adjacent the proximal end 244 by a threaded fastener 254. As shown, the fastener 254 is threadedly received within a threaded bore 256 defined by the body 224 and includes a head 258 for retaining the spring 250 thereon. As illustrated, the fastener is disposed within a proximal chamber 260 defined by the bore 248 and positioned between the fluid port 240 and the piston chamber 238. A second end 262 of the spring 250 is coiled around a head 264 of a second threaded fastener 266. The fastener 266 secures the second end 260 to the piston 228. In the illustrated embodiment, the fastener is threadedly received within a threaded bore 268 defined by the piston 228. The spring 250 is at least partially received within a threadless internal bore 270 defined by the piston 228 for maintaining the spring 250 in a radially centered position relative to the piston 228.

The piston 228 includes a proximal portion 272 having an outer surface 274 appropriately sized to slidably engage the body 224 defining the bore 226. In the illustrated embodiment, the configuration of the piston 228 and the body 224 allows the moveable portion 228,234 to be guided and to react to moment loads applied to the moveable jaw 234. A hydraulic seal 276 is annularly disposed between the piston 228 and the bore 226 to prevent hydraulic fluid received in the bore 226 via the port 240 from passing thereby. In the illustrated embodiment, the seal 272 is a T-shaped seal disposed in a circumferential groove 278 defined in an outer surface 274 of the piston proximal portion 272.

The clamp body 224 additionally defines an intermediate bore 280 connected to the bore 226 and spaced immediately adjacent the bore 226 in the direction of the distal end 232. The intermediate bore 280 is preferably concentric with and slightly larger in diameter than the proximal bore 226 which provides some clearance for the piston 228 when the piston is moved toward the distal end 232.

The piston 228 includes a distal portion 282 protruding from the proximal portion 272. The distal portion 282 is concentric with the proximal portion 270 but smaller in diameter. The distal portion 282 has an outer surface 284 that is sized to mate with or be received within a cap bore 286. The cap bore 286 is defined within a cap 288 secured within the distal end 232 of the clamping body 224.

More particularly, the clamping body 224 defines a distal bore 290 connected to the intermediate bore 280 and immediately adjacent both the intermediate bore and the distal end 232. The distal bore 290 is preferably concentric with and slightly larger in diameter than the intermediate bore 280. The cap 288 is securely received within the distal bore 290. The cap 288 includes a radial flange 292 that mates against a shoulder 294 defined in the body 224 to limit axial insertion of the cap into the bore 290. In one embodiment, the outer diameter of the cap 288 is such that it forms an interference fit with the bore 290 to prevent axial pullout of the cap 288 from the body 224. Specifically, the radial flange 292 is received within a counterbore 296 adjacent the distal end 232.

The fixed jaw 230 includes a removeable fixed jaw insert 300 mounted to the clamping body 224 via set screw 302. The set screw 302 is provided primarily for locating the insert 300 on the clamping body 224. Axial loads on the insert 300 are countered or taken by a shoulder 224*a* integrally formed as part of the clamping body 224 and received in a recess 300*a* of the insert 300. As is known to those skilled in the art, according to one embodiment, the fixed jaw insert 300 is configured for engaging one of a swage ring (such as swage ring SR of FIG. 3) and a fitting or connector body (such as connector body CB of FIG. 4). Because the insert 300 is removably fastened to the body 224 by the set screw 302, the insert is easily removed and interchanged with another insert (not shown). Readily mounting a second insert may be desirable when replacing the insert 300 or for installing an insert for use with a specified fitting and/or swage ring.

The moveable jaw includes an engaging member 304 annularly disposed about the piston distal portion 282 and a removeable moveable jaw insert 306 mounted to the engaging member 304 via set screw 308. Like the set screw 302, the set screw 308 is provided primarily for locating the insert 306 on the engaging member 304. Axial loads on the insert 306 are countered or taken by a shoulder 304*a* integrally formed as part of the engaging member 304 and received within a recess 306*a* of the insert 306. According to one embodiment, the moveable jaw insert 306 is configured for engaging the other of the swage ring SR and the fitting body CB. Thus, the moveable jaw 234 and the fixed jaw 230 together engage the swage ring SR and the fitting body CB for purposes of moving the swage ring onto the fitting body when the moveable jaw is moved or closed toward the fixed jaw. Like the fixed jaw insert 300, because the moveable jaw insert 306 is removably fastened to the engaging member 304 by the set screw 308, the moveable jaw insert is easily removed and interchanged with another moveable jaw insert (not shown), as might be desirable when using the tool 210 with various sized fittings in replacing the insert.

In the illustrated embodiment, the engaging member 304 includes a throughhole 310 that receives the piston distal portion 282 therethrough. The outer surface 284 of the distal portion 282 is slightly larger in diameter relative to the diameter of the throughhole 310 creating a press-fit or interference condition which fixedly mounts the engaging member 304 on the piston 228. A shoulder 312 is formed on the piston 282 between the proximal and distal portions 272,282. The shoulder 312 is configured to abut or engage the engaging member 304 and move the engaging member toward the distal end 232 when the piston is forcibly moved by the hydraulic fluid received in the chamber 238. With the moveable jaw insert 306 attached to the engaging member 304, movement of the piston 228 to forcibly move the engaging member 304 has the effect of moving the moveable jaw insert 306 toward the fixed jaw insert 300.

A bearing pad 314 is provided between a portion 304*b* of the engaging member 304 that extends along the clamping body 224 and a surface 224*b* of the clamping body 224. Specifically, the bearing pad 314 is received within a recess 316 defined in the engaging member portion 304*b*. The bearing member 314 is adapted to slidably move along the surface 224*b* as the moveable jaw 234 is moved toward the fixed jaw 230. The bearing pad 314 reacts with a moment force created when a piston force running though the center of the piston 228 is translated laterally to the center of the fitting as it is placed in the inserts 300 and 306. By absorbing or reacting to the moment force, the bearing pad 314 enables the engagement or interface between the moveable jaw 234 and the piston 228 to only have to deal with axial forces.

The pump body 216 includes a pump bore 330 having a pump piston 332 received therein. The bore 330 and the pump piston 332 define a pump chamber 334 for receiving hydraulic fluid from the bladder 214. The piston 332 serves to move hydraulic fluid from the bladder 214 through the chamber 334 and into the chamber 238. A seal 336 is annularly disposed within a groove 338 defined in the piston 332 to prevent the hydraulic fluid from passing by the piston and escaping from the pump body 216.

A first passageway is provided for fluidly connecting the bladder 214 to the pump chamber 334. Communication between the bladder 214 and the pump chamber 334 through the first passageway 340 is the same as described in reference to the first embodiment concerning the installation tool 10 and will not be described in detail with respect to the installation tool 210. Like the installation tool 10, with specific reference to FIG. 6, the installation tool 210 includes a first supply check valve 342, such as a ball valve, disposed in the first passageway 340 for selectively controlling fluid communication between the bladder 214 and the pump chamber 334. In the illustrated embodiment, the valve 342 is a one-way check valve that allows fluid communication from the bladder 214 to the chamber 334, but prevents fluid flow from the chamber 334 back to the bladder 214. Also like the first embodiment, the pump body 216 is connected to the handle 212 by a connector 344.

At an end of the pump piston 332 opposite an end received in the pump chamber 334, an external yoke 346 is formed and engaged to a force transfer pin 348. The force transfer pin 348 is mounted to the handle 218 so that upon movement of the handle 218 the force transfer pin 348 moves the pump piston 332 up and down in the pump chamber 334. More particularly, movement of the handle 218 relative to the handle 212 (as indicated by the arrow 350 in FIG. 6) causes a reciprocating movement of the piston 332 in the chamber 334 for moving fluid through the tool 210. Movement of the handle 218 apart from the handle 212 is limited by engagement between force transfer pin 348 and boss 354 mounted on the body 216. In the illustrated embodiment, boss or raised member 354 is welded to the body 216 so as to be integral therewith. Pin 220 is received through handle throughholes 218*a* and boss member throughhole 354*a*.

A second passageway 360 fluidly connects the pump chamber 334 to the chamber 238. The second passageway 360 is partially defined by the pump body 216 and partially formed by a throughhole 362 defined in an articulating assembly 364. As will be described in more detail below, the articulating assembly 364 mechanically and fluidly connects the pump body 216 to the clamping assembly 222. In particular, the articulating assembly rotatably connects the clamping assembly 222 to the pump body 216. The articulating assembly 364 includes a first member 366 having threads 368 that threadedly engage a threaded portion 370 of a threaded a bore 372 defined in the pump body 216. The bore 372 partially defines the second passageway 360 into the pump body 216. A seal 374 is disposed radially between the first member 366 and the pump body 216 defining the bore 372. In the illustrated embodiment, the seal 374 is received within a counterbore section 376 defined in the pump body about the bore 372.

A second valve 378, positioned between the pump chamber 334 and piston chamber 238, is disposed within the second passageway 360 for controlling fluid communication between the chamber 234 and the chamber 238. The valve 378 is urged to a closed position by a spring 380 wherein fluid flow from the chamber 238 to the chamber 334 is prevented. More particularly, the valve 378, which is a ball valve in the illustrated embodiment, seals and seals against a surface 382 and prevents fluid flow from the chamber 238 to the chamber 334. The second passageway 360 further includes a narrow passage 384 directly and fluidly connected to the chamber 334. A bore 386 fluidly connects the narrow passage 384 to the bore 372. The ball valve 378 is disposed within the bore 386 and rests against the surface 382, when in a closed position, which connects the narrow passageway 384 to the bore 386. The spring 380 is axially positioned between the ball valve 378 and the first member 366 of the articulating assembly 364. Specifically, one end of the spring 380 partially receives the ball valve 378 and the other end of the spring is received within a counterbore 388 disposed about the through passageway 362 in the first member 366.

A threaded member 392 locks the orientation of the first member 366 relative to the pump body 216. More particularly, the threaded member 392 is received on a portion of the threads 368 protruding from the pump body 216. A lock ring can be axially disposed between the threaded member 392 and the pump body 216.

The articulating assembly 364 further includes a second member 398 having threads 400 that threadedly engage the internal threads 246 of the fluid port portion 242. A seal 402 is radially disposed between a portion of the second member 398 extending into the port 240 and a beveled surface of the fluid port portion 242. The seal 402 prevents hydraulic fluid from escaping the tool 210 by passing between the clamping body 224 and the second member 398. The second member 398 includes a flange portion 406 having a shoulder 408 that abuts an outer surface 410 of the clamping body 224. The threaded connection between the second member 398 and the clamping assembly 222 fixedly secures the second member to the clamping assembly.

The articulating assembly 364 allows the tool 210 to be used, or at least more easily used, in a variety of work places, including close quarters environments or other constrained areas. More particularly, the articulating assembly 364 allows the clamping assembly 222 to be rotatably moved relative to the pump body 216 and the handles 212,218 along at least two axes. In the illustrated embodiment, with reference to FIG. 9, the articulating assembly 364 allows the clamping assembly 222 to be rotated about a first axis 412 relative to the pump body 216 and the handles 212,218 and allows the clamping assembly 222 to be rotated about a second axis 414 relative to the pump body 216 and the handles 212,218. Thus, the clamping assembly 222 can be positioned on fitting F to be swaged while allowing the pump body 216 and handles 212,218 to be moved about to avoid obstacles that would otherwise hinder operation of the handles 212,218.

The clamping assembly 222 and pump 216 with the handles 212,218 extending therefrom are moveable relative to one another about two axes, such as axes 412,414. As will be appreciated by those skilled in the art, movement about two axes generally allows the clamping assembly 222 and the pump body 216 to be moved relative to one another and oriented in generally any position relative to one another. In the illustrated embodiment, the first axis 412 is approximately normal relative to the second axis 414. For allowing movement about the two axes 412,414, the articulating assembly 364 includes a third member 416, also referred to herein as a first or primary swivel, that rotatably connects the first member 366 to the second member 398.

Figure 9:
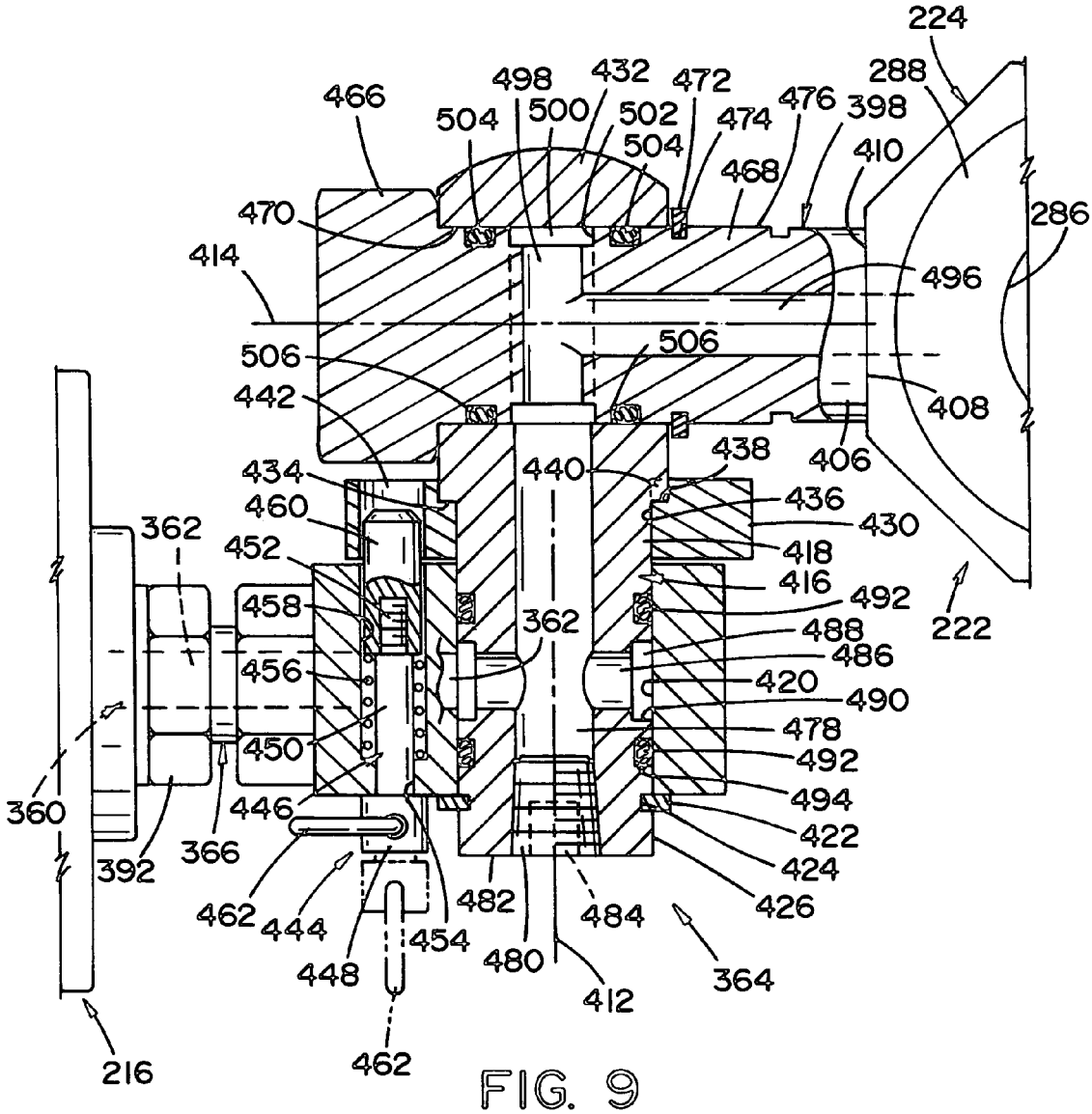
FIG. 9 is an enlarged cross-sectional view of the installation tool of FIG. 6 taken along the line 9-9 of FIG. 8.

With continued reference to FIG. 9, the first swivel 416 is disposed along the first axis 412 and allows movement of the clamping assembly 222 relative to the pump body 216 about the first axis. The second member 398, also referred to herein as a secondary swivel, is disposed along the second axis 414 and allows rotation of the clamping assembly 222 about the second axis which is generally parallel to an axial extent of the handles 212,218. While allowing movement about the axes 412,414, the articulating assembly 364 also allows continuous fluid communication between the throughhole 362, both shown in FIG. 8.

As will be described in more detail below, rotation about the first axis 412 is indexed at a plurality of predetermined positions. The first swivel 416 includes a shaft portion 418 received in a throughbore 420 defined by the first member 366. A retaining ring 422 received in a circumferential groove 424 defined in an outer surface 426 of the first swivel 416 prevents axial pullout of the first swivel 416 from the throughbore 420. An indexing plate 430 is fixedly and nonrotatably connected to the first swivel 416. The swivel 416 further includes a head portion 432 having a diameter greater than that of the shaft portion 418. The indexing plate 430 is annularly disposed about the swivel 416 and, more specifically, a radial shoulder 434 of the swivel 416 defined between the shaft portion 418 and the head portion 432.

More particularly, the indexing plate 430 includes a throughhole 436 into which the head portion 432 is received. The indexing plate 430 is radially and nonrotatably secured to the first swivel 416. In the illustrated embodiment, the plate 430 includes slots or recesses 438 that receive flats or keys 440 integrally formed on the first swivel 416 to nonrotatably connect the plate to the swivel. In the illustrated embodiment, the keys 440 are formed as part of the head portion 432 and define the shoulder 434. The shoulder 434 defined at the end of each key 440 limits axial insertion of the first swivel 416 into the indexing plate 430 and the first member 366. The indexing plate 430 and the first member 366 are axially locked into position between the shoulders 434 and the retaining ring 422.

The indexing plate 430 defines a plurality of apertures, which in the illustrated embodiment are slots or throughholes 442 which extend axially through the indexing plate. The slots 442 are radially spaced from the throughhole 436 and circumferentially spaced relative to one another. A pin assembly 444 is mounted to the first member 366 and selectively engageable with the indexing plate 430 to lock the second member 416 relative to the first member 366. More particularly, the pin assembly 444 includes a pin 446 that is moveable between an engaged position wherein the pin is received in one of the throughholes 442 to lock rotation between the members 366,416 and a disengaged position wherein rotation between the members 366,416 is allowed.

The pin 446 has a head portion 448, a shaft portion 450 and a threaded portion 452. The head portion 448 has a diameter larger than a throughhole 454 defined by the first member 366 and into which the pin 446 is received, thereby limiting axial insertion of the pin 446 into the first member 366. A spring 456 is annularly disposed about the shaft portion 450 and secured within a counterbored portion 458 of the throughhole 454. A threaded cap 460 has a diameter that substantially matches, or is slightly smaller than, a diameter of the counterbored portion 458 and substantially matches, or is slightly smaller than, diameters of the throughholes 442. The cap 460 is threadedly connected to the threaded portion 452 of the pin 446.

The diameter of the cap 460 is larger than that of the throughhole 454, which limits axial pullout of the pin assembly 444 from the first member 366. The spring 456 urges the cap 460 into the indexing plate 430 so that when one of the throughholes 442 is aligned with the pin assembly 444, the pin 446 is urged toward the engaged position, wherein the cap 460 is received in aligned throughhole 442. The head portion 448 includes a ring 462 for facilitating manual moving of the pin assembly 444 to the disengaged position, shown in phantom lines, wherein the cap 460 is removed from the throughhole 442 and rotation of the swivel 416 relative to the first member 366 is allowed. As already mentioned, the indexing plate 430 is nonrotatably connected (i.e., no relative rotation is allowed) and annularly disposed about the swivel 416. In the illustrated embodiment, the nonrotatable connection is a key 440 and slot 438 arrangement, but any other known nonrotatable connection could be employed, for example, an interference fit with a knurled engagement.

The second swivel 398 is rotatably connected to the first swivel 416. More particularly, like the first swivel 416, the second swivel 398 is generally cylindrical in shape. The second swivel 398 includes a head portion 466 and an elongated or shaft portion 468 which is received in a throughhole 470 defined in the first swivel 416. The head portion 466 limits axial insertion of the second swivel 398 into the throughhole 470 and a retaining ring 472 annularly received in a circumferential groove 474 defined in an outside surface 476 of the second swivel 398 limits axial pullout of the second swivel from the first swivel.

In the illustrated embodiment, relative movement between the first swivel 416 and the second swivel 398 is not indexed. However, it should be appreciated by those skilled in the art that relative movement between the swivels 398,416 could be indexed, either in a manner similar to the indexed relative movement between the first member 366 and the first swivel 416 or in some other manner known to those skilled in the art. Relative movement that is not indexed allows more freedom of movement, whereas indexed relative movement allows one member to be locked in position relative to the other member. Thus, in the illustrated embodiment, only movement between the first swivel 416 and the first member 366 is indexed. However, in alternate embodiments, neither or both of the swivels could be indexed for movement relative to the mating member to which the swivel is rotatably connected.

Fluid communication between the passageway 362 of the first member 366 (which forms a portion of the second passageway 360) and the fluid port 240 is maintained irrespective of the positions of (1) the first swivel 416 relative to the first member 366 and (2) the second swivel 398 relative to the first swivel 416. For this purpose, the first swivel 416 has an axially extending passageway 478 defined along an entire axial extent of the shaft portion 418 and along the head portion 432 to the throughhole 470. A plug 480 is disposed in the throughhole 478 adjacent a distal end 482 of the first swivel 416 for closing or sealing that end of the passage 478. In the illustrated embodiment, the plug includes a tool recess 484 and threads for threadedly engaging corresponding threads provided in the recess adjacent the distal end 482. The threaded connection between the plug 480 and the first swivel 416 employs a tapered thread system known to be fluid tight to those skilled in the art.

A plurality of radially extending passages 486 fluidly connect the passage 478 to an annular chamber 488 defined by circumferential groove 490 defined in the outer surface 426 of the first swivel 416. The groove 490 is axially positioned along the swivel 416 so as to be aligned with the passageway 362 extending through the first member 366. Thus, the passage 478 is always fluidly connected to the passageway 362 via the annular chamber 488 and the radial passages 486. 0-ring seals 492 are secured in circumferential grooves 494 axially flanking the circumferential groove 490 to seal fluid communication between the first member 366 and the first swivel 416.

With reference to FIGS. 8 and 9, the second swivel 398 includes an axially extending passage 496 in fluid communication with the fluid port 240 of the clamping assembly 222. 0-ring seal 402 prevents fluid from escaping between the second swivel 398 and the fluid port portion 242 defining the fluid port 240. With specific reference to FIG. 9, a plurality of radially extending passages 498 fluidly connect the passage 496 to an annular chamber 500 defined by a circumferential groove 502 defined in the outside surface 476 of the second swivel 398. The groove 502 is axially positioned along the swivel 398 so as to be aligned with the passage 478 extending through the first swivel 416. Thus, the passage 496 is always fluidly connected to the passage 478 via the annular chamber 500 and the radial passages 498. O-ring seals 504 are received in circumferential grooves 506 axially flanking the circumferential groove 502 to seal fluid communication between the first swivel 416 and the second swivel 398.

Although not illustrated in detail, the installation tool 210 includes a pressure release assembly 510 that is the same or similar as the pressure release assembly 170 of the first embodiment described herein. Thus, the pressure release assembly 510 includes a bypass passageway fluidly connecting the second passageway 360 to the bladder 214. A valve is disposed in the bypass passageway for controlling fluid communication therethrough. A valve actuator 512 is operatively connected to one end of the valve and includes a knob 514 for manually opening the valve. Operation of the valve occurs as described above in reference to the installation tool 10.

With reference back to FIG. 6, the flexible bladder 214 is adapted to be filled with hydraulic fluid and allows the fluid to enter and exit the bladder 214 without creating a vacuum effect, as discussed in reference to the bladder 14 of the installation 10 of the first embodiment. A plug 516 is provided for closing and opening of the bladder that is used for purposes of initially filling the bladder. Preferably, as discussed in reference to the bladder 14, when the bladder 214 is filled with hydraulic fluid, all air is purged or removed therefrom, as well as from other chambers, fluid passageways and the like of the tool 210.

In operation, the installation tool 210 functions like the installation tool 10 of the first embodiment. More particularly, the second handle 218 is moved apart from the first handle 212 which creates a vacuum in the chamber 334. As a result, hydraulic fluid from the bladder 214 enters the chamber 334. The vacuum force created is sufficient to allow the hydraulic fluid to pass by the supply check valve 342. Once in the chamber 334, the valve 342 operates to prevent the hydraulic fluid from reentering the bladder 214. The second handle 218 is then moved toward the first handle 212 which pressurizes the fluid in the chamber 334. The pressurized fluid is still prevented from entering the bladder 214 by the check valve 342 and instead forces open the valve 378 against the force of the spring 380. Thus, the fluid is forced through the second passageway 360, through the passages 486,478,498,496 of the articulating assembly 364 and into the piston chamber 238 of the clamping assembly 222.

This action, the movement of the piston 332, can then be repeated thereby forcing more pressurized fluid into the chamber 238. When the piston 332 is raised, the valve 378 operates to prevent fluid already in the chamber 238 from returning to the pump chamber 334 which results in fluid being drawn into the chamber 334 from the bladder 214. Thus, more and more fluid can be drawn from the bladder 214 with each stroke of the piston 332 and forced into the chamber 238 to move the piston 228 of the clamping assembly 222. Movement of the piston 228 results in movement of the moveable jaw 234 toward the fixed jaw 230 as indicated by arrow 518 (FIG. 6). As is known, the jaws 230,234 can be used for axially moving the swage ring SR onto the fitting body CB to sealingly connect the fitting body CB to the fluid conduit C.

As described in reference to the first embodiment installation tool 10, the pressure release assembly 510 of the installation tool 210 can be used to direct hydraulic fluid from the chamber 238 back to the bladder 214 for releasing the hydraulic force acting against the piston 228. As fluid moves from the chamber 238 back toward the bladder 214, the clamping assembly spring 250 is able to move the piston 228 with the moveable jaw 234 attached thereto away from the fixed jaw. When desirable to again close the jaws 230,234, the release assembly 510 can be closed and the handle 218 can be again pumped to reciprocally move the pump piston 332 and ultimately the piston 228.

During operation of the installation tool 210, the articulating assembly 364 allows the clamping assembly 222 to be rotatably moved relative to the pump body 216 and the handles 212,218. As already described, relative movement between the clamping assembly 222 and the pump body 216 can occur along one or both axes 412,414. Primary movement or articulation occurs about the axis 412, which is indexed in the illustrated embodiment, and secondary movement or articulation occurs about the axis 414.

To move the clamping assembly 222 about the primary axis 412 while holding the handles 212,218, the ring 462 is grasped and pulled to remove the pin or locking assembly 444 from the indexing plate 430. With the pin assembly 444 removed, the primary swivel 416 is freely rotatable relative to the first member 366. Thus, the entire clamping assembly 222 is rotatable relative to the pump body 216 and handles 212,218 about the primary axis 412. When the primary swivel 416 and the indexing plate 430 nonrotatably connected thereto are rotated to an indexed position (i.e., a position wherein the pin assembly 444 is aligned with one of the plurality of indexing throughholes 442), the ring 462 can be released so that the pin assembly 444 returns to its engaged position with the indexing plate 430 (i.e., the pin assembly 444 is urged into the aligned throughhole 442 by the spring 456) to lock the position of the clamping assembly 222 relative to the pump body 216.

Figure 10:
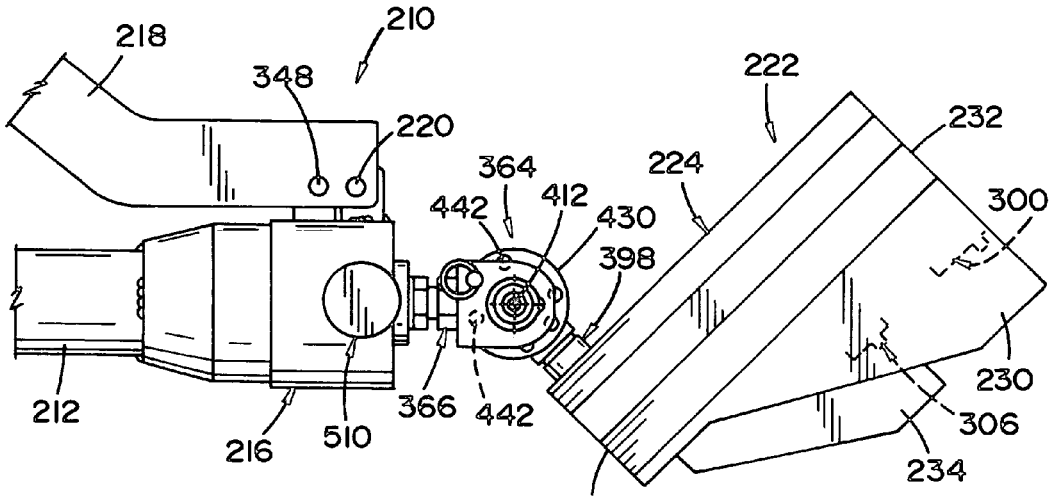
FIG. 10 is a partial side elevational view of the installation tool of FIG. 6 showing a clamping assembly partially articulated about a tool body of the installation tool.
Figure 11:
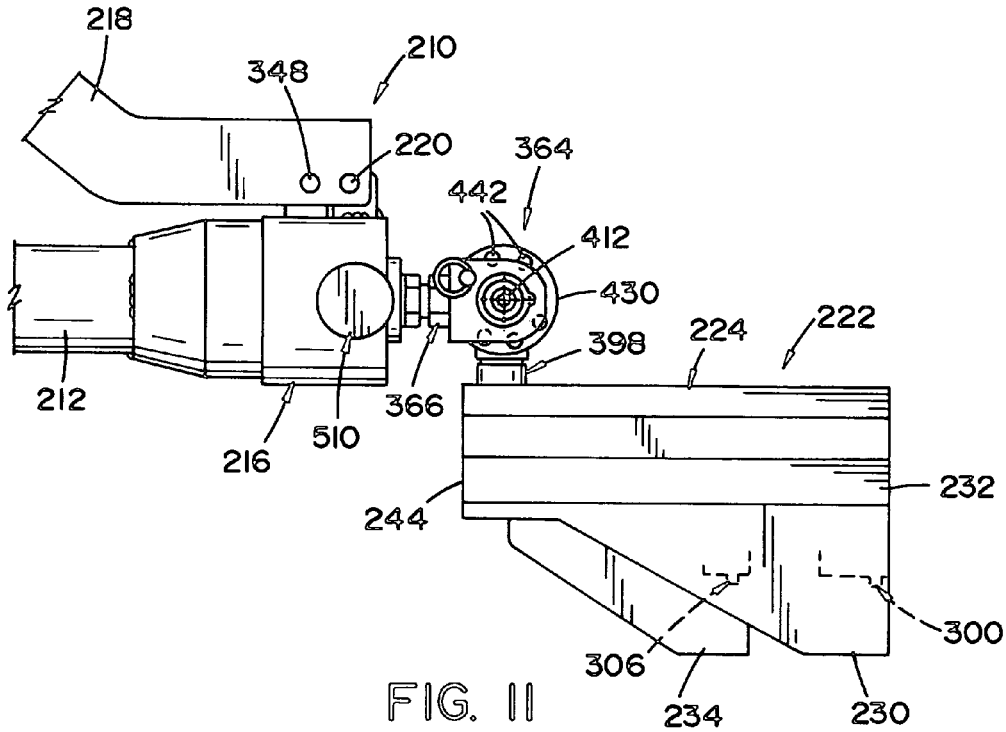
FIG. 11 is a partial side elevational view of the installation tool of FIG. 6 showing the clamping assembly fully articulated about a tool body of the installation tool.

In the illustrated embodiment, throughholes 442 are positioned in the indexing plate 430 so that the clamping assembly 222 can be moved from an initial position relative to the pump body 216 (shown in FIG. 6) to at least a first position (shown in FIG. 10) wherein the clamping assembly 222 is positioned approximately forty-five degrees (45°) relative to the pump body 216 and a second position (shown in FIG. 11) wherein the clamping assembly 422 is positioned approximately ninety degrees (90°) relative to the pump body 216. Of course, as will be appreciated and understood by those skilled in the art, any number of indexing throughholes could be provided in the indexing plate 430 and the indexing throughholes could be provided in any variety of circumferential positions on the indexing plate for purposes of locking the clamping assembly 222 in any number of corresponding positions relative to the pump body 216.

Since the tool 210 includes removeable inserts 300,306, these inserts can be removed and replaced with other inserts. More specifically, to install replaceable inserts, as may be desirable when using the tool 210 with various sizes of fittings, the set screws 302,308 are simply loosened so the inserts 300,306 can be disconnected from, respectively, the body 224 and the engaging member 304. With the inserts 300,306 removed, other inserts can be connected to the clamping assembly 222 via the same or like set screws 302,308. Use of other inserts may be desirable when using the tool 210 with fittings of various sizes. For example, inserts may be provided and selectively used that correspond to a fitting of a specific size or fittings that fall within a range of sizes. Additionally, removability of the inserts 300,306 allows for replacement of the inserts, as may be necessary after extended use over time.

The invention has been described with reference to one or more embodiments. Obviously, modifications and alterations will occur to others upon reading and understanding the preceding detailed description. It is intended that the invention be construed as including all such modifications and alterations which are intended to be encompassed by the following claims.

The invention claimed is:

1. A handheld hydraulic assembly tool for advancing a fitting's swage ring onto a fitting's connector body while a conduit is received in the connector body to mechanically and sealingly connect the fitting to the conduit, said hydraulic assembly tool comprising:

a clamping assembly defining a piston chamber hoselessly fluidly connected to a pump chamber so as to form a compact assembly tool, said clamping assembly having a fixed jaw engaged with one of the connector body or the swage ring and a moveable jaw engaged with the other of the connector body or the swage ring, said fixed and movable jaws configured to engage and axially force the swage ring onto the connector body to connect and seal the connector body to the conduit received therein;

a piston disposed in said piston chamber; said piston and said moveable jaw configured such that movement of said piston in a first direction moves said moveable jaw toward said fixed jaw thereby moving the swage ring axially onto the connector body to mechanically and sealingly connect the connector body to the conduit received therein when the jaws are engaged to the connector body and the swage ring;

a pump body defining said pump chamber, said pump body connected to the clamping assembly in close proximity thereto to form a compact handheld tool;

a fluid reservoir fluidly connected to said pump chamber; and a manually-operated pump piston disposed in said pump chamber for drawing hydraulic fluid from said fluid reservoir and forcing said hydraulic fluid into said piston chamber to move said piston in said first direction.

2. The handheld hydraulic tool of claim 1 further including:

a first handle connected to said pump body and having said fluid reservoir disposed therein; and a second handle pivotally connected to said pump body and moveable relative to said first handle, said second handle connected to said pump piston so that movement of said second handle moves said pump piston.

3. The handheld hydraulic tool of claim 2 wherein movement of said second handle apart from said first handle moves said pump piston in a direction enlarging said pump chamber thereby drawing fluid from said fluid reservoir into said pump chamber and subsequent movement of said second handle toward said first handle moves said pump piston in a direction contracting said chamber thereby forcing said hydraulic fluid drawn into said pump chamber into said piston chamber.

4. The handheld hydraulic tool of claim 1 further including a spring urging said piston in a second direction opposite said first direction, said urging by said spring moving said moveable jaw apart from said fixed jaw unless said hydraulic fluid provides sufficient force against said piston to overcome said urging of said spring.

5. The handheld hydraulic tool of claim 4 wherein said spring is one of (i) a tension spring that applies a tension force on said piston for urging said piston in said second direction or a (ii) a compression spring that applies a compression force on said piston for urging said piston in said second direction.

6. The handheld hydraulic tool of claim 1 further including:

a first valve between said fluid reservoir and said pump chamber that allows said hydraulic fluid to be drawn from said fluid reservoir into said pump chamber and prevents hydraulic fluid in said pump chamber from returning to said fluid reservoir; and a second valve between said pump chamber and said piston chamber that allows hydraulic fluid in said pump chamber to be forced into said piston chamber and prevents hydraulic fluid in said piston chamber from directly returning to said pump chamber.

7. The handheld hydraulic tool of claim 6 further including a pressure release assembly for selectively allowing said hydraulic fluid to pass from said piston chamber back to said fluid reservoir upon manual actuation thereof and bypass said first and second valves.

8. The handheld hydraulic tool of claim 1 wherein said moveable jaw is integrally formed with said piston.

9. The handheld hydraulic tool of claim 1 wherein at least one of said fixed jaw and said moveable jaw includes a removeable jaw insert.

10. The handheld hydraulic tool of claim 1 wherein said pump body is fixedly and nonrotatably connected to said clamping assembly.

11. A handheld hydraulic assembly tool for advancing a fitting's swage ring onto a fitting's connector body while a conduit is received in the connector body to mechanically and sealingly connect the fitting to the conduit, said hydraulic assembly tool comprising:

a clamping assembly defining a piston chamber fluidly connected to a pump chamber, said clamping assembly having a fixed jaw engaged with one of the connector body or the swage ring and a moveable jaw engaged with the other of the connector body or the swage ring, the movable jaw being adapted to move in a direction generally parallel to the axial direction of the connector body or the swage ring;

a piston disposed in said piston chamber; said piston and said moveable jaw configured such that movement of said piston in a first direction moves said moveable jaw toward said fixed jaw thereby moving the swage ring axially onto the connector body to mechanically and sealingly connect the connector body to the conduit received therein when the jaws are engaged to the connector body and the swage ring;

a pump body defining said pump chamber, said pump body connected to the clamping assembly in close proximity thereto to form a compact handheld tool;

a fluid reservoir fluidly connected to said pump chamber;

a manually-operated pump piston disposed in said pump chamber for drawing hydraulic fluid from said fluid reservoir and forcing said hydraulic fluid into said piston chamber to move said piston in said first direction;

a first handle connected to said pump body and having said fluid reservoir disposed therein;

a second handle pivotally connected to said pump body and moveable relative to said first handle, said second handle connected to said pump piston so that movement of said second handle moves said pump piston; and an articulating assembly rotatably connecting said clamping assembly to said pump body.

12. The handheld hydraulic tool of claim 11 wherein said articulating assembly (i) allows said clamping assembly to be rotated about a first axis relative to said pump body and said first and second handles and (ii) allows said clamping assembly to be rotated about a second axis relative to said pump body and said first and second handles.

13. The handheld hydraulic tool of claim 12 wherein said first axis is approximately normal relative to said second axis.

14. The handheld hydraulic tool of claim 12 wherein rotation about at least one of said first axis and said second axis is indexed at a plurality of predetermined positions.

15. A handheld hydraulic assembly tool for advancing a fitting's swage ring onto a fitting's connector body while a conduit is received in the connector body to mechanically and sealingly connect the fitting to the conduit, said hydraulic assembly tool comprising:

a clamping assembly defining a piston chamber fluidly connected to a pump chamber, said clamping assembly having a fixed jaw engaged with one of the connector body or the swage ring and a moveable jaw engaged with the other of the connector body or the swage ring, the movable jaw being adapted to move in a direction generally parallel to the axial direction of the connector body or the swage ring;

a piston disposed in said piston chamber; said piston and said moveable jaw configured such that movement of said piston in a first direction moves said moveable jaw toward said fixed jaw thereby moving the swage ring axially onto the connector body to mechanically and sealingly connect the connector body to the conduit received therein when the jaws are engaged to the connector body and the swage ring;

a pump body defining said pump chamber, said pump body connected to the clamping assembly in close proximity thereto to form a compact handheld tool;

a fluid reservoir fluidly connected to said pump chamber;

a manually-operated pump piston disposed in said pump chamber for drawing hydraulic fluid from said fluid reservoir and forcing said hydraulic fluid into said piston chamber to move said piston in said first direction, and an articulating assembly rotatably connecting said clamping assembly to said pump body said articulating assembly (i) allowing said clamping assembly to be rotated about a first axis relative to said pump body and said first and second handles and (ii) allowing said clamping assembly to be rotated about a second axis relative to said pump body and said first and second handles, rotation about said first axis is indexed at a plurality of predetermined positions.

16. The handheld hydraulic tool of claim 15 wherein the articulating assembly includes:

a first swivel disposed along said first axis for allowing rotation of said clamping assembly relative to said pump body about said first axis; and a second swivel disposed along said second axis for allowing rotation of said clamping assembly relative to said pump body about said second axis.

17. The handheld hydraulic tool of claim 16 wherein said articulating assembly further includes:

an indexing plate fixedly and nonrotatably connected to said first swivel, said indexing plate defining a plurality of apertures extending axially relative to said first swivel, said plurality of apertures each circumferntially spaced relative to one another; and a pin selectively engagable with a selective one of said plurality of apertures to lock rotation about said first axis in a desired position.

18. The handheld hydraulic tool of claim 15 wherein rotation about said second axis is indexed at a plurality of predetermined positions.

19. A method of mechanically and sealingly connecting a fitting to a conduit using a handheld hydraulic assembly tool, comprising:

securing fixed and moveable jaws of the hydraulic assembly tool to a swage ring of the fitting and a connector body of the fitting with a conduit received in the connector body, said fixed and movable jaws configured to engage and axially force the swage ring onto the connector body to connect and seal the connector body to the conduit received therein;

manually operating a pump piston disposed in a pump chamber of the hydraulic assembly tool;

drawing hydraulic fluid from a fluid reservoir of the hydraulic assembly tool into said pump chamber when said pump piston is moved in a first direction;

forcing said hydraulic fluid drawn into said pump chamber into an adjacent piston chamber of the hydraulic assembly tool when said pump piston is moved in a second direction, said piston chamber fluidly connected to said pump chamber without a flexible hose;

repeating said steps of drawing hydraulic fluid from said fluid reservoir into said pump chamber and forcing said drawn hydraulic fluid in said pump chamber into said piston chamber;

moving a piston disposed in said piston chamber with said hydraulic fluid forced in said piston chamber; and moving said moveable jaw, with said piston, toward said fixed jaw to axially move the swage ring onto the connector body to mechanically and sealingly connect the connector body to the conduit received therein.

20. A handheld hydraulic assembly tool comprising:

a clamp body defining a piston chamber;

a fixed jaw one of formed integrally with said clamp body or secured to said clamp body;

a moveable jaw secured to and moveable relative to said clamp body, wherein said fixed and moveable jaws are configured to engage and axially force a swage ring onto a fitting body to connect and seal said fitting body to a fluid conduit received in said fitting body;

a piston disposed in said piston chamber, movement of said piston in a first direction moves said moveable jaw toward said fixed jaw;

a tool body defining a pump chamber which is hoselessly fluidly connected to said piston chamber so as to form a compact assembly tool;

a fluid reservoir fluidly connected to said pump chamber; and a pump piston disposed in said pump chamber and adapted to draw a hydraulic fluid from said fluid reservoir and force said hydraulic fluid into said piston chamber to move said piston in said first direction thereby moving said moveable jaw toward said fixed jaw.

21. The handheld hydraulic assembly tool of claim 20 further including an articulating assembly rotatably connecting said clamp body to said tool body for movement about two axes.

22. The handheld hydraulic assembly tool of claim 21 wherein said articulating assembly indexes movement about at least one of said two axes.

23. The handheld hydraulic assembly tool of claim 20 further including a first handle connected to said tool body and a second handle pivotally connected to said tool body and moveable relative to said first handle, said second handle connected to said pump piston so that movement of said second handle moves said pump piston.

24. The handheld hydraulic assembly tool of claim 20 further including a spring urging said piston in a second direction opposite said first direction.

25. The handheld hydraulic assembly tool of claim 20 further including:

a first valve between said reservoir and said pump chamber that allows said hydraulic fluid to be drawn from said fluid reservoir into said pump chamber and prevents hydraulic fluid in said pump chamber from returning to said fluid reservoir; and a second valve between said pump chamber and said piston chamber that allows hydraulic fluid in said pump chamber to be forced into said piston chamber and prevents hydraulic fluid in said piston chamber from directly returning to said pump chamber; and a pressure release assembly for selectively allowing said hydraulic fluid to pass from said piston chamber back to said reservoir upon manual actuation thereof and bypass said first and second valves.

* * * * *